US012616875B2

(12) United States Patent
Grosjean et al.

(10) Patent No.: US 12,616,875 B2
(45) Date of Patent: May 5, 2026

(54) AUTO-BELAY NOTIFICATION SYSTEM

(71) Applicant: CityRock LLC, Colorado Springs, CO (US)

(72) Inventors: Joseph Grosjean, Colorado Springs, CO (US); William R. Huseby, Vancouver, WA (US)

(73) Assignee: CityRock LLC, Colorado Springs, CO (US)

( * ) Notice: Subject to any disclaimer, the term of this patent is extended or adjusted under 35 U.S.C. 154(b) by 174 days.

(21) Appl. No.: 18/671,776

(22) Filed: May 22, 2024

(65) Prior Publication Data

US 2024/0390734 A1 Nov. 28, 2024

Related U.S. Application Data

(60) Provisional application No. 63/503,909, filed on May 23, 2023.

(51) Int. Cl.

| | |
|---|---|
| ***A63B 24/00*** | (2006.01) |
| ***A63B 69/00*** | (2006.01) |
| ***A63B 71/06*** | (2006.01) |

(52) U.S. Cl.

CPC ..... *A63B 24/0062* (2013.01); *A63B 69/0048* (2013.01); *A63B 71/0622* (2013.01); (Continued)

(58) Field of Classification Search

CPC ..... A63B 24/0062; A63B 71/0622; A63B 69/0086; A63B 69/0064; A63B 69/0059; A63B 69/0048; A63B 2071/0627; A63B 2209/08; A63B 2220/13; A63B 2220/833; A63B 2220/89; A63B 2225/02; A63B 2225/54; A63B 21/0058; A63B 21/153; A63B 21/00181

See application file for complete search history.

(56) References Cited

U.S. PATENT DOCUMENTS 8,408,360 B2 4/2013 Postma
9,589,437 B2 * 3/2017 McGowan ..... A63B 9/00
(Continued)

FOREIGN PATENT DOCUMENTS

EP 4343729 A1 * 3/2024 ..... G08B 21/02

*Primary Examiner* — Megan Anderson
*Assistant Examiner* — Jonathan A Dicuia
(74) *Attorney, Agent, or Firm* — Lee & Hayes, P.C.

(57) ABSTRACT

Methods and systems are provided to aid a rock climber in remembering to attach to an auto-belay system prior to climbing. In one embodiment, a climbing notification system includes a climber component coupled to a harness. The climber component includes a first portion with a single sensor and an alarm; a second, detachable portion semi-permanently attached to a first, bottom surface of the first portion where the second, detachable portion is magnetically couplable to the first portion. The first portion may include a processor and a power source; wherein, in a first condition where the second, detachable portion is magnetically coupled to first portion, the alarm is disabled; and in a second condition, where the second, detachable portion is detached from the first portion, the alarm is generated in response to the single sensor detecting a threshold proximity to an antenna positioned at a predetermined height.

19 Claims, 13 Drawing Sheets

(52) U.S. Cl.
CPC ... *A63B 2071/0627* (2013.01); *A63B 2209/08* (2013.01); *A63B 2220/13* (2013.01); *A63B 2220/833* (2013.01); *A63B 2220/89* (2013.01); *A63B 2225/02* (2013.01); *A63B 2225/54* (2013.01)

(56) References Cited

U.S. PATENT DOCUMENTS

| | | | | |
|---|---|---|---|---|
| 2008/0185221 | A1* | 8/2008 | Postma | A63B 69/0048<br>700/80 |
| 2013/0035219 | A1* | 2/2013 | Williams | A63B 21/152<br>482/110 |
| 2023/0264053 | A1* | 8/2023 | Mcmullan-Martin | G08B 21/02<br>182/231 |

* cited by examiner

AUTO-BELAY NOTIFICATION SYSTEM

CROSS-REFERENCE TO RELATED APPLICATIONS

This application claims priority to U.S. Provisional Patent Application No. 63/503,909 filed on May 23, 2023. U.S. Provisional Patent Application No. 63/503,909 is incorporated by reference herein in its entirety.

TECHNICAL FIELD

Embodiments of the subject matter disclosed herein relate to auto-belay systems used when practicing rock climbing.

BACKGROUND

Rock climbing is a popular activity that is often carried out on artificial climbing walls in indoor or outdoor environments. In such environments, climbers usually work with a partner to mitigate falls. Generally, a rope is wrapped around a metal bar (known as a belay bar) anchored to the top of a climbing wall so that the rope extends up from the ground, around the belay bar, and back down to the ground in what is referred to as a top-rope set-up. Thus, the rope has an ascending portion extending from the ground or floor up to the belay bar, and a descending portion extending down to the ground or floor from the belay bar. An end of an ascending portion of the rope is attached to the harness of the climber with a knot, and a partner of the climber (e.g., a belayer) secures the descending portion of the rope to the partner's harness using a belay device. When the rope is taut, the weight of the climber may be supported by the rope, with the weight of the partner (and friction from the rope wrapped around the belay bar) providing a counterbalancing force. The rope is secured to the partner's harness through the belay device, which includes a friction-based braking mechanism that may arrest or slow a fall of the climber if utilized correctly. As the climber climbs up the climbing wall, the partner can also control the movement of the rope through the belay device, to take up slack in the rope, or to provide slack in the rope when requested by the climber. As such, the safety of the climber is dependent on the attentiveness of the belaying partner, both during climbing, and during a setup of the belay by the partner. Prior to starting to climb, the climber and the partner generally perform a reciprocal check of each other's harnesses, knots, belay device, and/or other safety equipment used for climbing.

To reduce the dependency of the climber on the attentiveness of the belaying partner and to allow climbers without a partner to climb safely, modern climbing walls may include an auto-belay system, also referred to herein as an auto-belay. An auto-belay is a mechanical device that provides a way of lowering a climber to the ground after they have completed their climb. It may be installed at or near a top of a climbing wall and includes rope or webbing that descends down to the climber. For example, the webbing may be manufactured of a material similar to that of a seat belt, with a heavy-duty loop stitched at an end of the webbing. A carabiner may be sewn to the loop so that it is semi-permanently attached to the auto-belay webbing. Thus, the climber may attach the harness to the webbing via the carabiner (also referred to herein as "clipping in").

The auto-belay system maintains the webbing under light tension, and when not in use, an end of the descending webbing may be temporarily secured to anchor points on or near the bottom of the climbing wall. In some cases, the end of the descending webbing is secured to a cloth "gate" arranged at a starting point of a climbing route, where the gate is a large piece of fabric that may cover the starting point, to encourage the climber to clip into the auto belay.

When starting to climb, the climber detaches the end of the descending webbing from the climbing wall and attaches the webbing to the climber's harness, for example via a carabiner as described above. As the climber climbs, the auto-belay system retracts the webbing to maintain the appropriate tension. If the climber falls, a braking mechanism of the auto-belay system arrests the fall of the climber. When the climber reaches the auto-belay, the climber lets go of the wall, allowing the climber's weight to be held by the webbing, and the braking mechanism to be engaged, allowing the climber to be slowly lowered to the ground. However, current auto-belay systems rely on the climber to not only remember to clip into the auto-belay, but also to attach to the system appropriately. There is no partner to perform a reciprocal check. If the climber fails to clip into the auto-belay or incorrectly clips into the auto-belay, nothing may prevent the climber from falling to the ground and potentially injuring themselves.

SUMMARY

The current disclosure at least partially addresses one or more of the above identified issues by a climbing notification system, comprising a climber component coupled to a harness, the climber component comprising a first portion including a processor, a single sensor, a power source and an alarm; a second, detachable portion semi-permanently attached to a first, bottom surface of the first portion, the second, detachable portion magnetically couplable to the first portion; wherein, in a first condition where the second, detachable portion is magnetically coupled to first portion, the alarm is disabled; and in a second condition, where the second, detachable portion is detached from the first portion, the alarm is generated in response to the single sensor detecting a threshold proximity to an antenna positioned at a predetermined height. The climber component may be secured to a harness of a climber when the climber is climbing a climbing wall using an auto-belay system. The second, detachable section may be semi-permanently attached to the end of the webbing of the auto-belay, on or near the carabiner where the climber attaches, via a tether or cord. In some examples, the tether is a flexible, coiled tether that can adjust in length according to a specific size or needs of the climber.

Thus, when the climber attaches the carabiner at the end of the auto-belay to the harness of the climber (e.g., clips in), the climber may also magnetically attach the second, detachable portion tethered to the auto-belay to the first portion attached to the climber, thereby disabling the alarm. If the climber begins to climb without clipping in and without magnetically attaching the second portion to the first portion, the alarm will be generated when the climber reaches the predetermined height. The climber then has the opportunity to climb down or call for help descending the wall. The alarm may include illuminating a light on the first portion, and/or alert the climber in a different way, for example, through an audible alarm. Further, a volume of the alarm may be adjusted such that the alarm is audible to the climber, while minimizing a distraction to other nearby climbers. In some aspects, the type and cadence of the audible or visible alarm(s) may vary depending on the height of the climber. Additionally, the alarm may be personalized to avoid confusion regarding which climber is unprotected.

When the alarm is generated, if the climber is attached to the auto-belay but has not attached the second portion to the first portion, the climber may disable the alarm without having to descend, by magnetically attaching the second portion to the first portion, which may be accomplished with one hand. By providing individual, customized alarms at a lower volume than other sensing systems, and by enabling the climber to quickly disable the alarm, an annoyance and/or distraction created by the alarm for the climber, other climbers, and other persons in the environment may be minimized, resulting in a more pleasurable climbing experience and an increased climbing performance.

An additional advantage of the climbing notification system is that an output of the sensor is processed and the alarm is generated at the climber component, rather than at a separate component of the climbing notification system connected via a wireless network. As a result, the complexity and number of components of the climbing notification system that might fail may be reduced, increasing the usability of the climbing notification system while reducing costs. Safety of the climber may depend on a correct functioning and sufficient power of a single device (e.g., the climber component) with a single sensor, where the correct functioning and sufficient power may be indicated to the climber via one or more easily visible warning lights. The antenna at the predetermined height may be configured to permanently broadcast a signal receivable by the climber component (e.g., the antenna may not include a power switch), whereby the generation of the alarm may not be dependent on a wireless network and/or additional sensors and/or electrical components. Additionally, due to simplified circuitry, the power consumption of each individual climber component and the climbing notification system as a whole may be reduced. In this way, a more efficient and robust, climbing notification system may be achieved.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Various aspects of this disclosure may be better understood upon reading the following detailed description and upon reference to the drawings in which.

Figure 1:
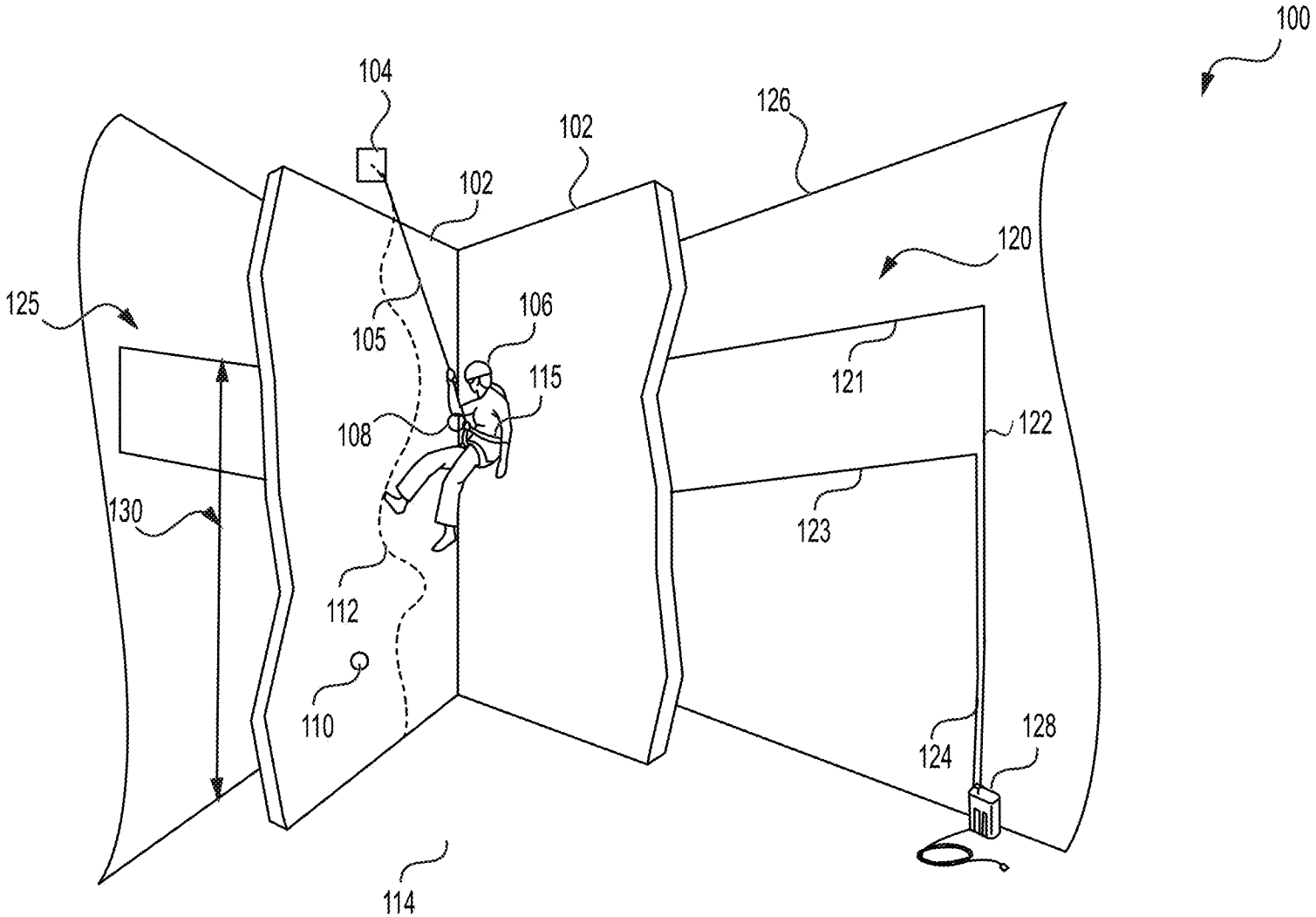
FIG. 1 is a schematic diagram illustrating a climbing notification system installed at an artificial rock climbing wall, in accordance with one or more embodiments of the present disclosure.

The drawings illustrate specific aspects of the described systems and methods. Together with the following description, the drawings demonstrate and explain the structures, methods, and principles described herein. In the drawings, the size of components may be exaggerated or otherwise modified for clarity. Well-known structures, materials, or operations are not shown or described in detail to avoid obscuring aspects of the described components, systems and methods.

DETAILED DESCRIPTION

Auto-belay systems provide a way to lower a climber to the ground after they have completed their climb. Unlike traditional climbing arrangements, the use of an auto-belay system eliminates the need for a human climbing partner. Current auto-belay systems rely on the climber to not only remember to clip into the auto-belay, but also to attach to the system appropriately. If the climber fails to clip into the auto-belay or incorrectly clips into the auto-belay, nothing may prevent the climber from falling to the ground and potentially injuring themselves.

Current auto-belay reminder systems are complex and have many potential failure points which could render them ineffective. Further, such systems may generate an alarm even when a climber is attached to the auto-belay system, for example, if the climber forgets to attach a supplemental device to their harness. In such cases, the climber may not be able to deactivate the alarm and continue climbing without first descending, which may be frustrating. Additionally, for large climbing facilities including multiple auto-belay systems, complex sensing systems lead to increased costs and manpower to maintain the devices.

The description and embodiments of the subject matter disclosed herein relate to methods and systems for a climbing notification system, as may be used in conjunction with an auto-belay system installed on a rock climbing wall, such as an artificial rock climbing wall. Various implementations of the present disclosure will be described in detail with reference to the drawings. Any examples set forth in this specification are not intended to be limiting and merely set forth some of the many possible implementations.

Figure 2:
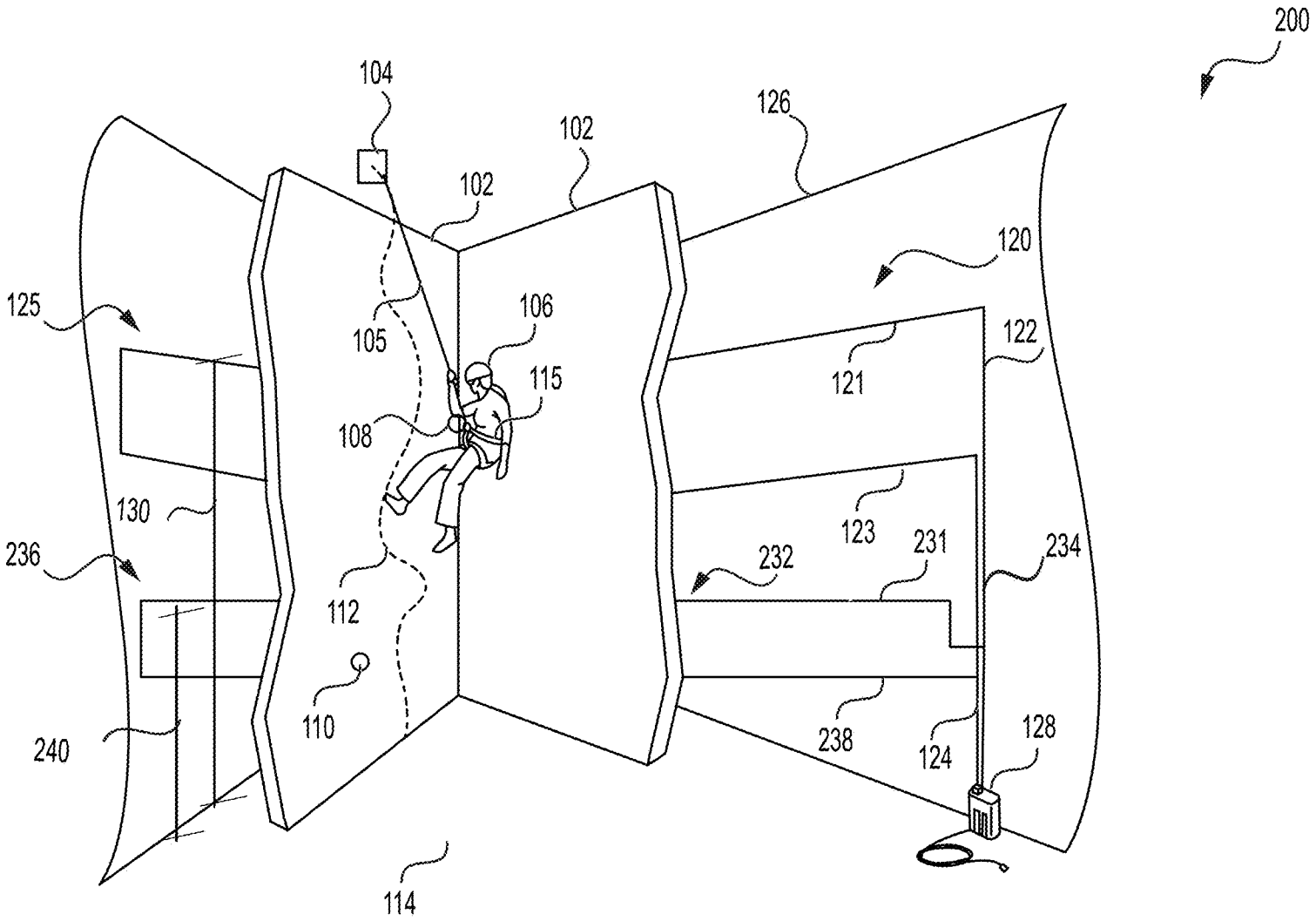
FIG. 2 is a schematic diagram illustrating a climbing notification system installed at an artificial rock climbing wall, in accordance with one or more embodiments of the present disclosure.
Figure 3:
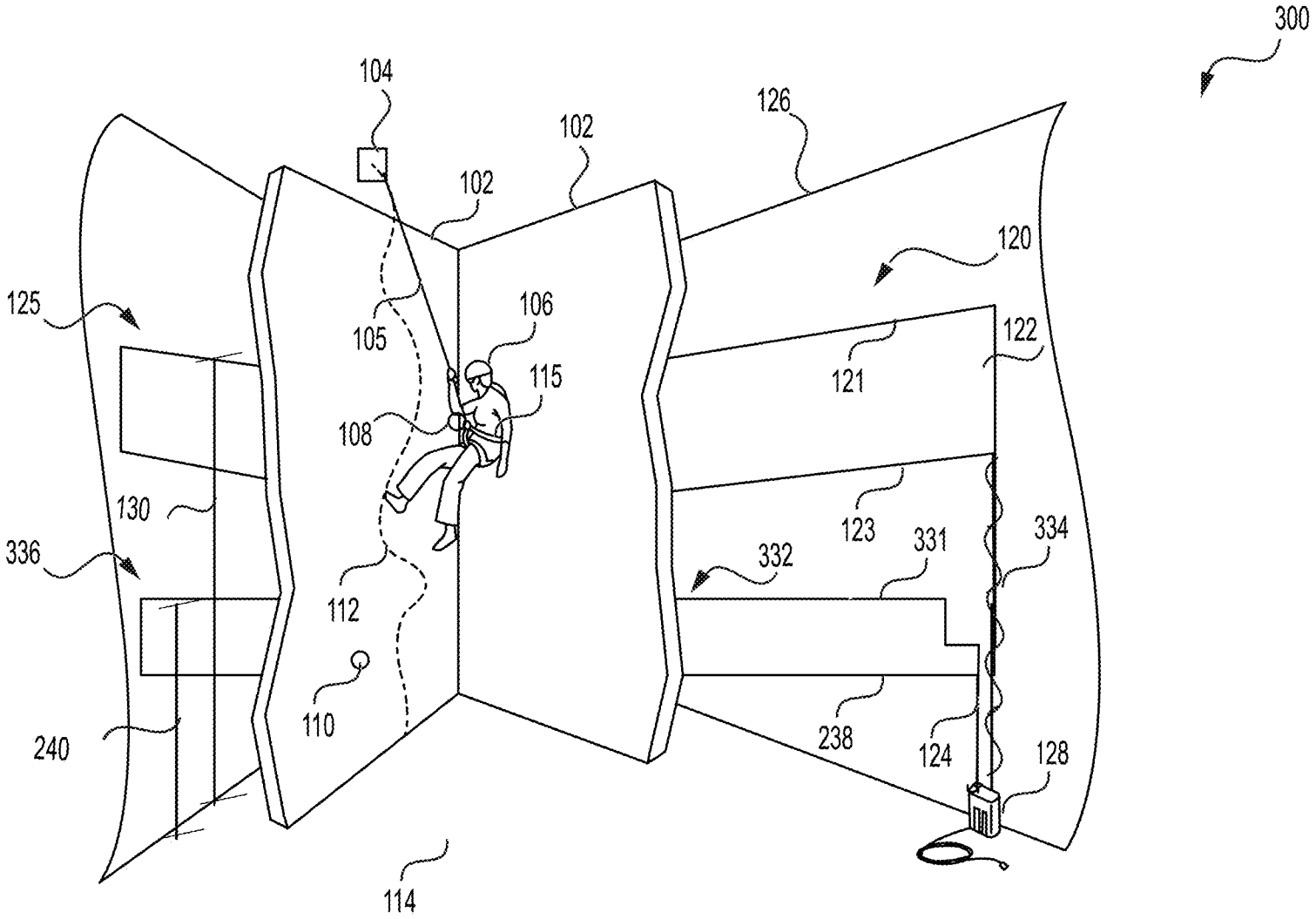
FIG. 3 is a schematic diagram illustrating a climbing notification system installed at an artificial rock climbing wall, in accordance with one or more embodiments of the present disclosure.
Figure 4A:
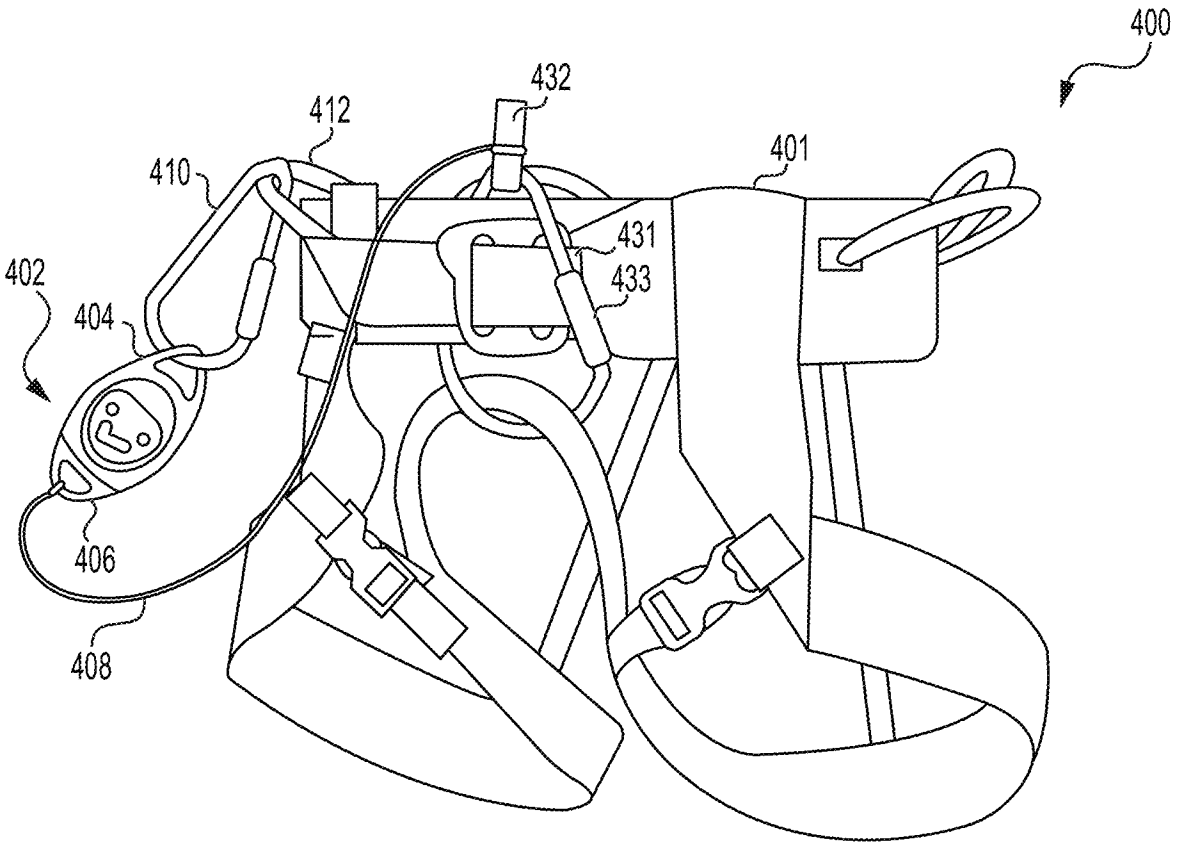
FIG. 4A shows a first exemplary configuration of a harness of a climber, the harness including a climber component of the climbing notification system, in accordance with one or more embodiments of the present disclosure.
Figure 4B:
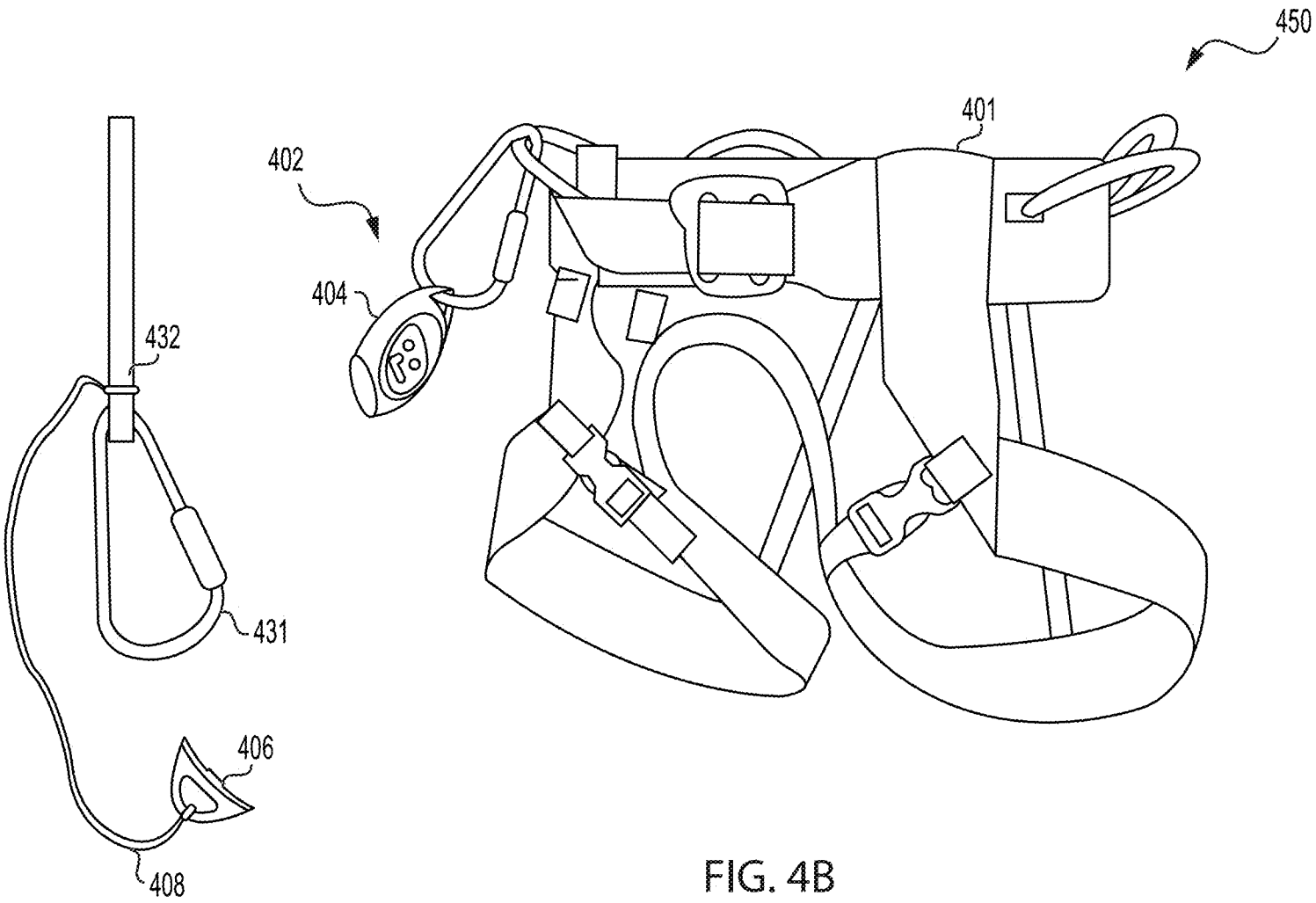
FIG. 4B shows a second exemplary configuration of the harness including the climber component of the climbing notification system, in accordance with one or more embodiments of the present disclosure.
Figure 5:
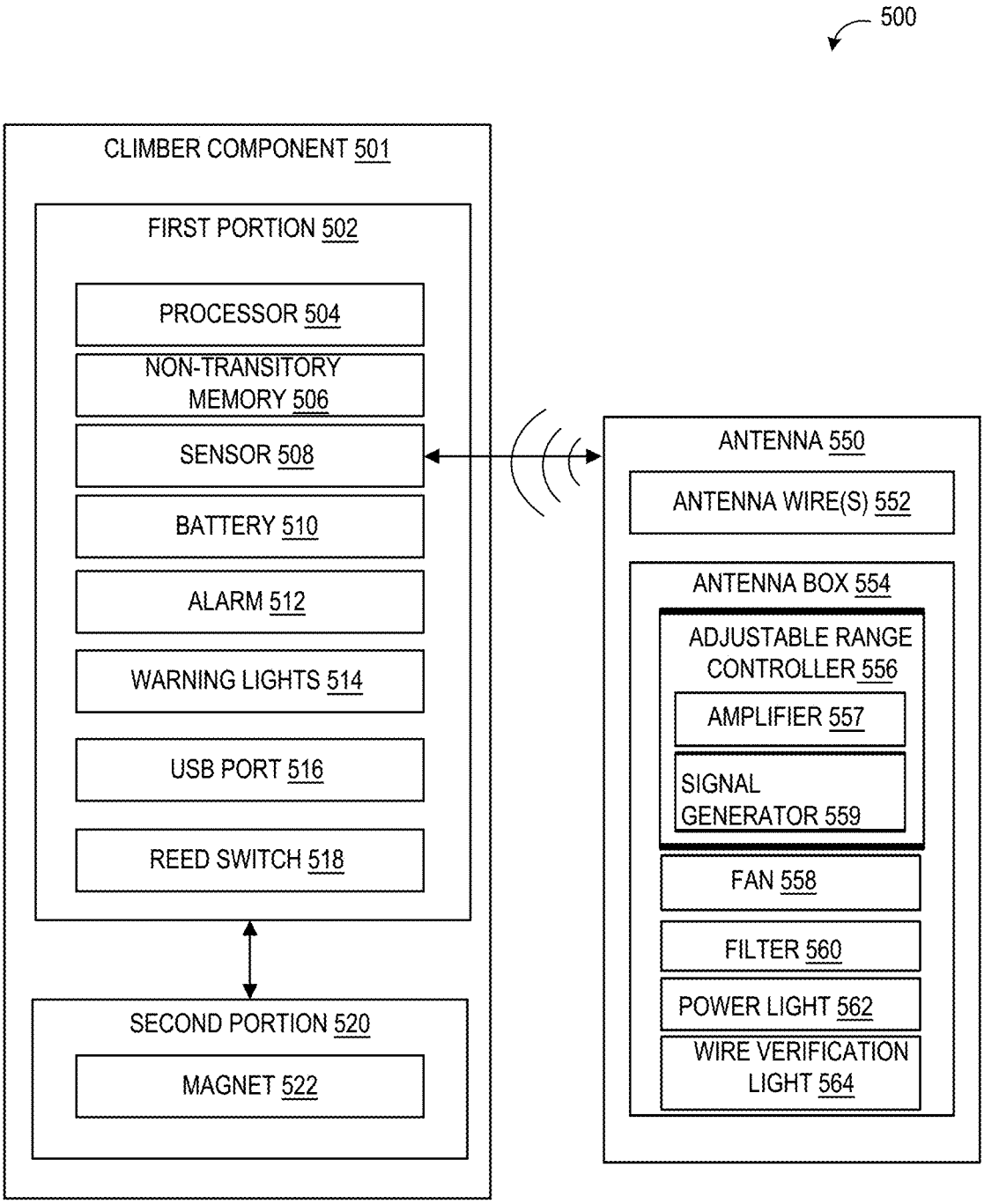
FIG. 5 shows a schematic diagram of the climbing notification system, in accordance with one or more embodiments of the present disclosure.

Exemplary climbing notification systems installed at a rock climbing wall are shown in FIGS. 1, 2, and 3 including antenna(s) installed at predetermined height(s) of the climbing wall. A climber component (e.g., a wireless alarm unit) of the climbing notification system clipped to a harness of the climber, is shown in FIGS. 4A and 4B. A schematic diagram of the climbing notification system is shown in FIG. 5.

Figure 6A:
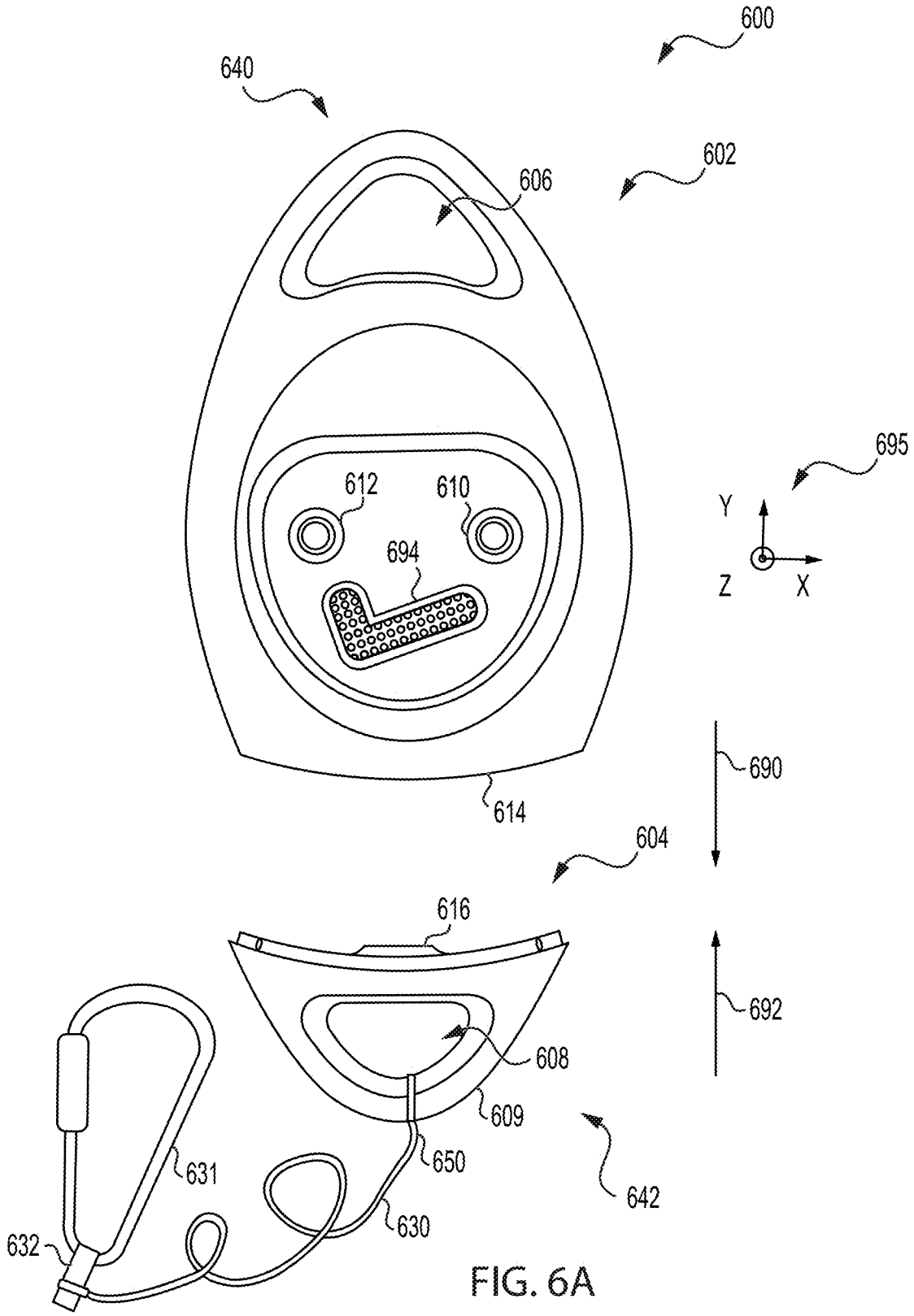
FIG. 6A shows a front view of a first portion and a second portion of the climber component in a first, detached configuration, in accordance with one or more embodiments of the present disclosure.
Figure 6B:
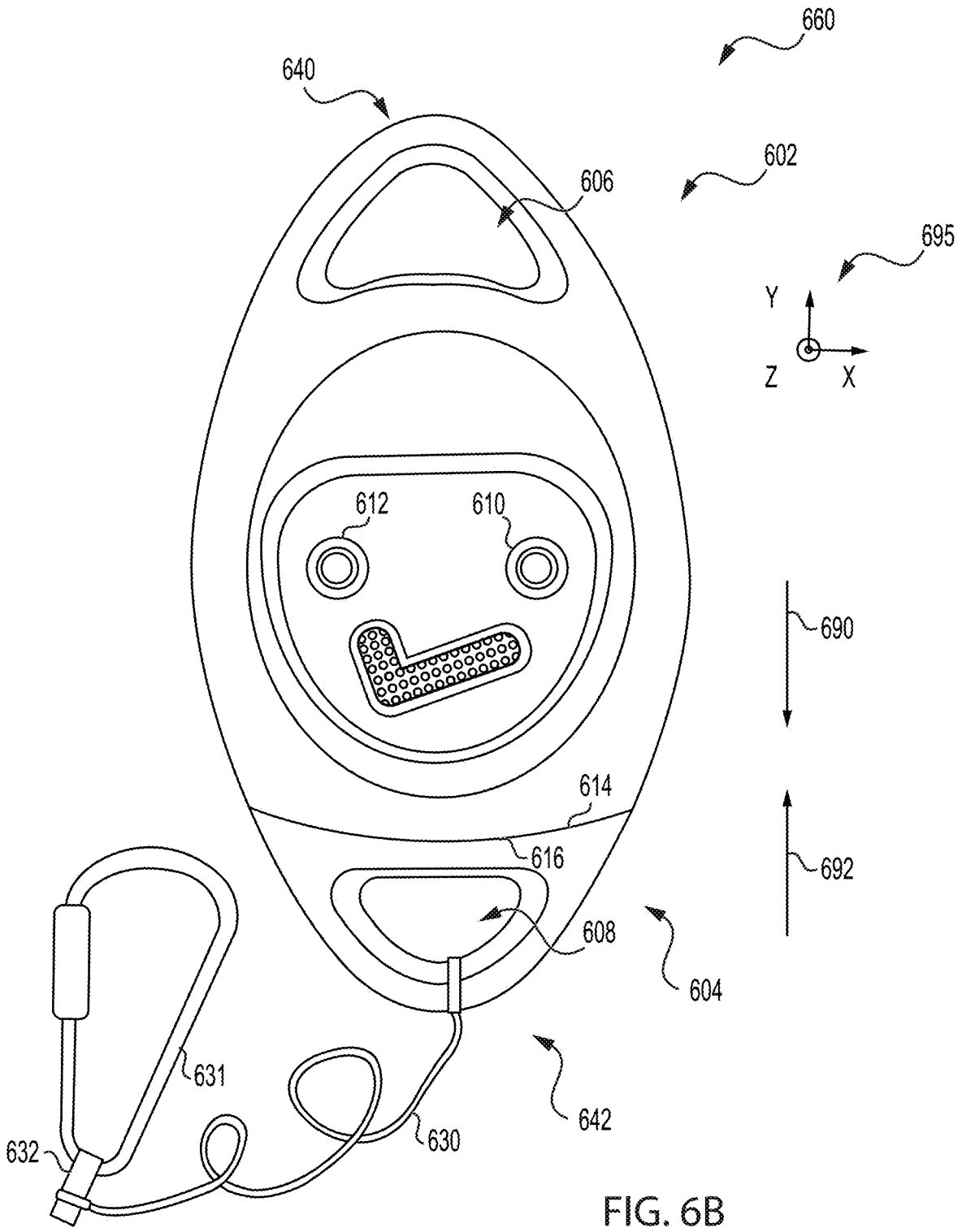
FIG. 6B shows a front view of a first portion and a second portion of the climber component in a second, attached configuration, in accordance with one or more embodiments of the present disclosure.

The climber component may have a first portion and a second portion, where the second portion may be detached from the first portion, as shown in FIG. 6A, or the second portion may be attached to the first portion magnetically at a bottom surface of the first portion, as shown in FIG. 6B. For example, the second portion may be semi-permanently attached to a carabiner coupled to an end of a rope or webbing of the auto-belay system (also referred to herein as the auto-belay carabiner) via a tether, and the second portion may be attached to the first portion by bringing a top surface of the second portion in contact with a bottom surface of the first portion. A housing of the first portion is shown in two sections in FIG. 7. In some aspects, the two pieces of the first portion are fused or otherwise formed into a single piece. FIG. 8 shows a perspective view of the second, detachable portion. The first portion may include an alarm, which may be activated if the climber reaches the predetermined height of the antenna without having attached the second portion to the first portion. Attaching the second portion to the first portion silences the alarm.

Prior to starting a climbing route on the climbing wall, the climber may attach the auto-belay carabiner to a harness of the climber, so that as the climber climbs up the climbing wall, the auto belay system protects the climber from falling via the webbing. When the climber attaches the auto-belay carabiner to the harness, the climber may magnetically attach the second portion of the climber component to the first portion of the climber component to deactivate the alarm. If the climber forgets to attach the auto-belay carabiner to the harness and does not magnetically attach the second portion of the climber component to the first portion of the climber component, when the climber reaches the predetermined height of the antenna, the alarm of the climber component may be activated.

Figure 9:
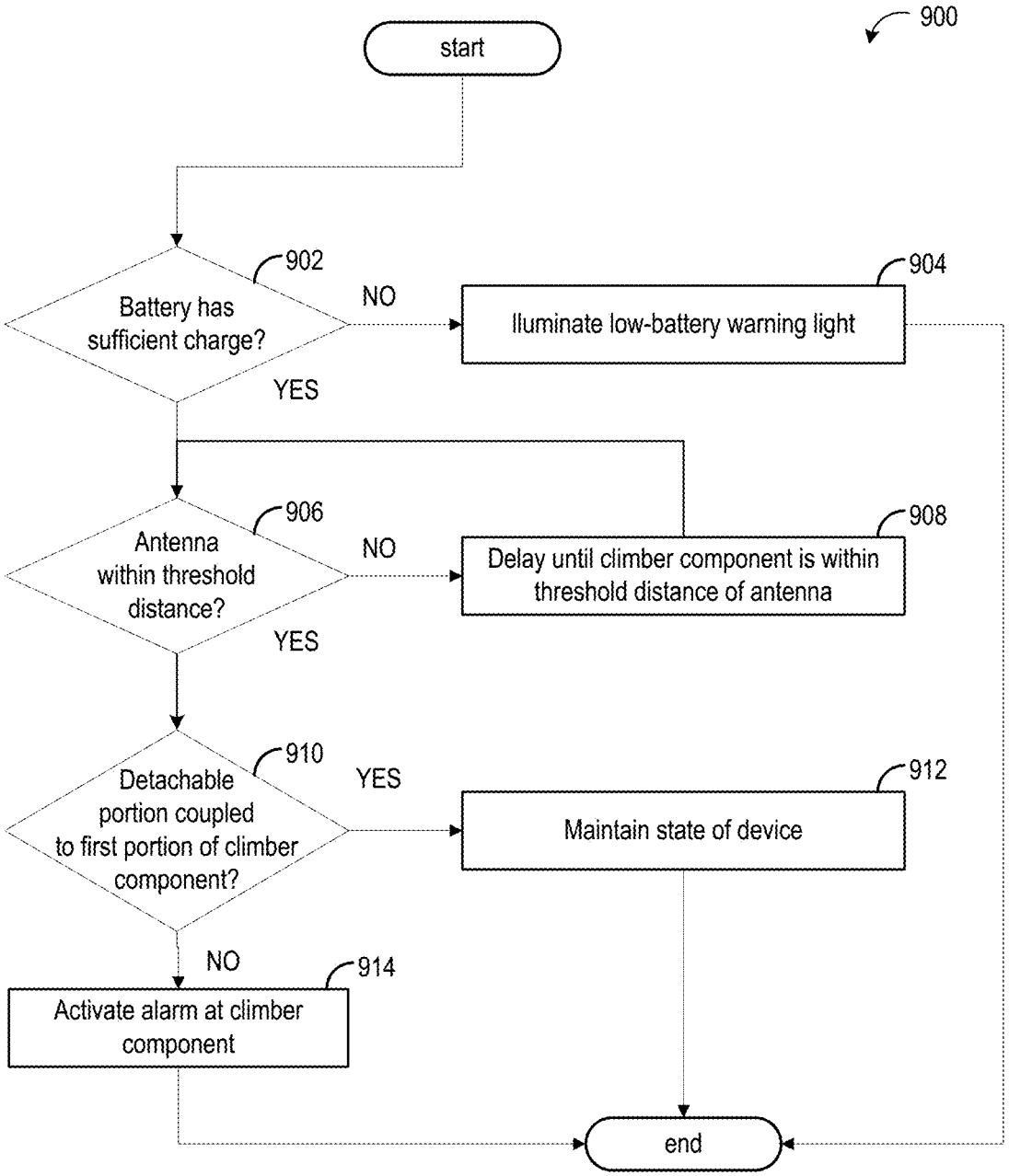
FIG. 9 shows an exemplary method for activating an alarm at the climber component in response to the climber entering a threshold proximity of an antenna of the climbing notification system, in accordance with one or more embodiments of the present disclosure.
Figure 10:
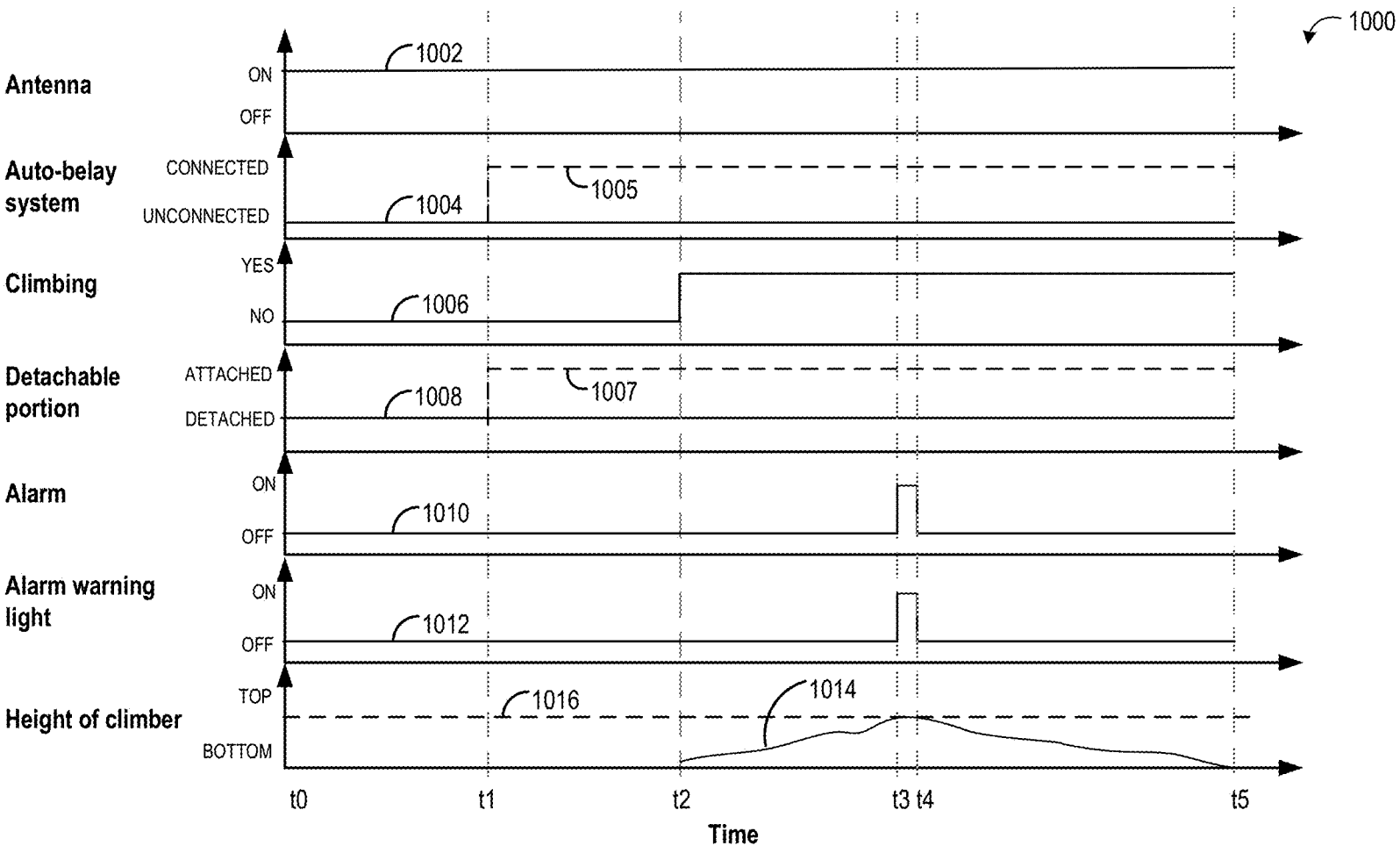
FIG. 10 is a first timing diagram illustrating a first sequence of events in which the alarm is generated, in accordance with one or more embodiments of the present disclosure.
Figure 11:
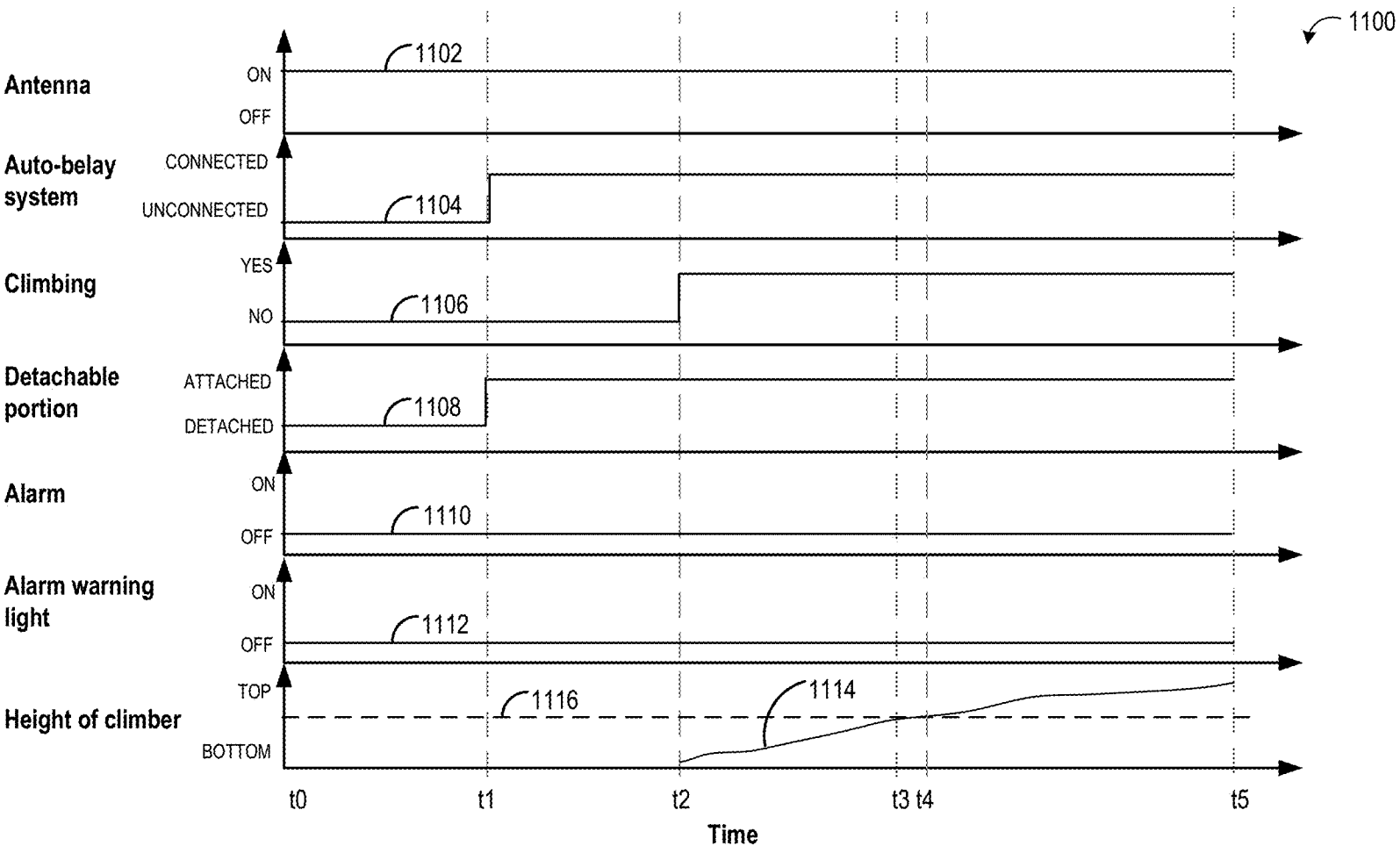
FIG. 11 is a second timing diagram illustrating a second sequence of events in which the alarm is not generated, in accordance with one or more embodiments of the present disclosure.

The activation of the alarm may be performed in accordance with a method shown in FIG. 9. FIG. 10 shows a first timing diagram illustrating a first sequence of events in which the climber does not attach the auto-belay carabiner to the harness and does not magnetically attach the second portion to the first portion, whereby the alarm is activated when the climber reaches the predetermined height of the antenna. FIG. 11 shows a second timing diagram illustrating a second sequence of events in which the climber does attach the auto-belay carabiner to the harness and does magnetically attach the second portion to the first portion, whereby the alarm is not activated when the climber reaches the predetermined height of the antenna.

While the climbing notification system is described herein as being used by indoor rock climbers, it should be appreciated that in other embodiments, the climbing notification system may be used in other environments and/or with other users secking protection from fall-related injuries without departing from the scope of this disclosure. For example, the climbing notification system described herein could be used to alert a worker such as a construction worker that they have exceeded a predetermined height.

FIG. 1 shows a climbing notification system 100, where climbing notification system 100 is installed at a rock climbing wall 102 and used in conjunction with an auto-belay system 104 installed at the rock climbing wall. Auto-belay system 104 may be installed at a top of a climbing route 112 on rock climbing wall 102 that may be climbed by a climber 106. Auto-belay system 104 includes a rope or webbing 105 used to protect climber 106 while ascending climbing route 112. Webbing 105 may be secured to a harness 115 of climber 106 using an auto-belay carabiner, as described above.

Auto-belay system 104 is a mechanical system including a braking mechanism, where webbing 105 is retracted by auto-belay system 104 as climber 106 ascends climbing route 112. In the event that climber 106 falls, the braking mechanism prevents webbing 105 from moving or decreases the movement of webbing 105, thereby slowing or stopping a fall of climber 106. Prior to initiating climbing route 112, the end of webbing 105 may be secured to a bottom anchor 110 installed on climbing wall 102. For example, bottom anchor 110 may include a metal ring secured to climbing wall 102, where an end of webbing 105 may be clipped to the metal ring via the auto-belay carabiner. The auto-belay carabiner is shown in FIGS. 4A and 4B.

In preparation for ascending climbing route 112, climber 106 may unclip the auto-belay carabiner from bottom anchor 110 and clip the auto-belay carabiner to harness 115. When the auto-belay carabiner is secured to harness 115, climber 106 may be protected from falling by auto-belay system 104. If the auto-belay carabiner is not secured to harness 115, climber 106 may not be protected from falling by auto-belay system 104. For example, in some circumstances, climber 106 may forget to unclip the auto-belay carabiner from bottom anchor 110 and clip the auto-belay carabiner to harness 115 and begin to climb route 112 without being protected from falling by auto-belay system 104.

Climbing notification systems 100, 200, and 300 may be used to aid climber 106 in not forgetting to secure the auto-belay carabiner to harness 115. Climbing notification systems 100, 200, and 300 include at least one antenna 120, which in the depicted example is attached to a wall 126 behind climbing wall 102. In other embodiments, antenna 120 may be attached to a back side of climbing wall 102 or inserted or built into climbing wall 102.

In the depicted examples, antenna 120 is a wire loop antenna including a wire loop 122. Wire loop 122 has a first portion 121 arranged horizontally along wall 126 at a first height behind climbing wall 102 to an end coverage point 125, with a second horizontal portion 123 of wire loop 122 looping back at a second height. The second height may be lower or higher than the first height.

In some aspects, as shown in climbing notification system 200, there may be a second antenna 234, though more antennas may also be added. Similar to first antenna 120, second antenna 234 has a wire loop 232. Wire loop 232 has a first portion 231 arranged horizontally along wall 126 at a third height behind climbing wall 102 to an end coverage point 236 with a second horizontal portion 238 of wire loop 232 looping back at a fourth height.

The third height as shown in FIGS. 2 and 3 of the climbing notification systems 200 and 300 respectively may be a predetermined height 240 from a floor or ground 114. Predetermined height 240 may be a height where the climber could easily downclimb. Further, a second loop at this height this allows other people around the climber to see and hear the alarm.

In some aspects, wire loop 122 and wire loop 332 are part of a same antenna as shown in FIG. 3 in which wire loop 332 forms a second complete loop of antenna 120. The second complete loop 332 is formed by twisting the vertical wires 334 of the antenna 120, causing the twisted portion to deactivate. In this manner wire loop 122 has a first portion 121 arranged horizontally along wall 126 at a first height behind climbing wall 102 to an end coverage point 125, with a second horizontal portion 123 of wire loop 122 looping back at a second height and a third horizontal portion 331 of wire loop 122 arranged horizontally along wall 126 at a third height behind climbing wall 102 to an end coverage point 336, with a fourth horizontal portion of wire loop 122 looping back at 336 before joining the antenna box 128.

The climbing notification systems 100, 200, and 300 include a climber component 108, which may be a wireless alarm unit configured to generate an alarm under certain conditions in response to receiving a wireless signal. In various embodiments, climber component 108 is attached to (e.g., tied to and/or clipped into) harness 115. In other embodiments, climber component 108 may be attached to other clothing worn by climber 106 or equipment carried by climber 106. Climber component 108 may be attached to harness 115 at a time of attaching the auto-belay carabiner to harness 115. Climber component 108 may include a sensor that may be configured to receive a radio frequency (RF) signal.

Antenna 120 may emit a signal, such as an RF signal. In some aspects, the signal is emitted continuously. The signal may be received by a sensor configured to receive signals at a frequency of the RF signal, such as the sensor included in climber component 108. Additionally, antenna 120 may include an adjustable range controller housed within an antenna box 128, which may control a strength of the RF signal and a distance within which the RF signal may be received by the sensor. Antenna box 128 and the adjustable range controller within the antenna box 128 may be connected to wire loop 122 via a vertical connecting wire portion 124. In one embodiment, antenna box 128 further comprises a fan and a filter. In some aspects, the antenna box 128 may include a series of fans and filters to assist in decreasing dust. In some aspects, the antenna box 128 may be placed inside another box (not shown) with its own set of fans and/or filters. As climbing gyms frequently use chalk and the air may contain suspended particles, the addition of the second box and filter system may provide an additional layer of protection from airborne particles. In some aspects, the power light of the antenna box may be visible through the filter system, allowing the state of the antenna box to be determined without opening the various containers.

The RF signal emitted by the antenna may be configured by the adjustable range controller to have a first strength, where the sensor may receive the RF signal when the sensor is within a first distance of wire loop 122. For example, the first distance may be 2 feet. In other aspects, the RF signal may be configured by the adjustable range controller to have a second strength, where the sensor may receive the RF signal when the sensor is within a second distance of wire loop 122. For example, the second distance may be 4 feet. Thus, the adjustable range controller may be configured (e.g., by an operator of climbing notification system 100, such as a manager of climbing wall 102) such that the sensor detects the RF signal when the sensor enters a threshold proximity of wire loop 122 (e.g., either or both of first horizontal portion 121 and second horizontal portion 123) while climbing on climbing wall 102. The threshold proximity may depend on a distance between wall 126 and climbing wall 102, among other factors.

When climber 106 is climbing route 112 and reaches a predetermined height such as predetermined height 130 and/or predetermined height 240, the sensor of climber component 108 may enter into the threshold proximity of a wire loop. When the sensor enters into the threshold proximity, climber component 108 may generate an alarm, warning the climber 106 that the predetermined height 130 and/or predetermined height 240 has been reached, and the climber 106 should verify that they have attached the auto-belay carabiner to harness 115. In some embodiments, an alarm may additionally or alternatively be generated when climber 106 reaches other horizontal portions as shown in FIGS. 1, 2, and 3.

To avoid the generation of the reminder alarm when the predetermined height has been achieved, climber 106 may disable the alarm at climber component 108 prior to starting to climb route 112. In other words, when preparing to climb climbing route 112, and prior to initiating climbing on climbing route 112, climber 106 may detach the auto-belay carabiner from bottom anchor 110 and clip the auto-belay carabiner to harness 115. After the auto-belay carabiner is clipped to harness 115 and before starting to climb, climber 106 may disable the alarm at climber component 108 by magnetically attaching a second portion of the climber component to the first portion of the climber component.

In various embodiments, climber component 108 comprises a first, main portion, and a second, detachable portion. Climber component 108 may be provided in a detached configuration, where the second, detachable portion of climber component 108 may be detached from the first portion. In some aspects, the second, detachable portion may be connected to the end of webbing 105 or the auto-belay carabiner via a tether, such that the second, detachable portion may dangle from the end of the webbing 105 or the auto-belay carabiner when disassembled. When climber 106 is ready to begin climbing on route 112, climber 106 may disable the alarm at climber component 108 by attaching the second, detachable portion of climber component 108 to the first, main portion of climber component 108. In various embodiments, the second, detachable portion may be magnetically attached to the first, main portion via at least one magnet located in the second, detachable portion. Thus, to disable the alarm, climber 106 may grasp the second, detachable portion and magnetically attach the second, detachable portion to the first, main portion by bringing a first surface of the second, detachable portion in contact with a second surface of the first, main portion. When the second, detachable portion is magnetically attached to the first portion, a reed switch in the first portion may close an electrical contact to deactivate the alarm, whereby the alarm will not be generated when climber 106 reaches a predetermined height such as predetermined height 130. The position of the reed switch may be altered by the presence of a magnet in the second, detachable portion, allowing the presence of the second portion including the magnet to move the reed switch into the first or deactivated position and the removal of the magnet to move the reed switch to a second or activated position to activate the alarm. The use of a magnet may also allow for case of connection as well as a decrease in wear that may be seen in other connection methods.

While the example depicted in FIG. 1 shows a single horizontal wire loop 122, and FIGS. 2 and 3 show two wire loops, it should be appreciated that in other embodiments, more than two wires (or wire loops) 122 may be included. In some aspects, multiple antennas may be used, such as, for example as shown in FIG. 2. In other aspects, a single antenna may be looped multiple times as shown in FIG. 3.

When climber component 108 enters into a first threshold proximity of first horizontal wire loop 122 of FIG. 1, a first alarm may be generated at climber component 108. When climber component 108 enters into a second threshold proximity of a second horizontal wire loop such as wire loop 232 or wire loop 332, a second alarm may be generated at climber component 108. In some aspects, a first alarm may sound at the wire at the lowest height relative to the ground 114 and subsequent alarms may sound as the climber approaches or passes subsequent horizontal wires.

Further, the second alarm may be different from the first alarm. For example, the first alarm may be a more gentle warning than the second alarm. In other words, climber 106 may hear the first, more gentle alarm when climbing past the first height, and may hear the second, less gentle (e.g., louder or more rapid) alarm when climbing past the second or other subsequent heights. In other embodiments, a volume of the alarm may be based on a distance between climber component 108 and the horizontal wire loops, such that as climber 106 approaches a different wire loop, the alarm may be generated first at a lower volume, and a sound of the alarm may change. In some aspects, the sound of the alarm may vary depending on the proximity to a particular horizontal loop. Further, the alarms may set up in a sequential manner, that is as the climber moves farther away from one loop and closer to a subsequent loop, even though the climber is still in range of the one loop, the system may recognize that the climber is moving away from the one loop and towards the subsequent loop and the alarm may signal the approach to the subsequent loop.

When climber 106 climbs to the top of route 112 and reaches auto-belay system 104, climber 106 may be lowered to ground 114 by auto-belay system 104. When climber 106 reaches ground 114, climber 106 may reattach the auto-belay carabiner to bottom anchor 110. When climber 106 reattaches the auto-belay carabiner to bottom anchor 110, climber 106 may detach the second, detachable portion of climber component 108 from the first, main portion of climber component 108. In this way, a configuration of climber component 108 may be used to remind climber 106 whether climber 106 is attached to auto-belay system 104 or not. When climber 106 is attached to auto-belay system 104, the first portion of climber component 108 may also be attached to the second portion of climber component 108. When climber 106 is not attached to auto-belay system 104, the first portion of climber component 108 may not be attached to the second portion of climber component 108. The second portion is attached by climber 106 to the first portion when climber 106 clips into auto-belay system 104, and the second portion is detached by climber 106 from the first portion when climber 106 clips out of auto-belay system 104. Thus, the configuration of climber component 108 is used as an aid to climber 106 for remembering to clip into auto-belay system 104 when climbing on climbing wall 102.

FIG. 4A shows a first exemplary harness configuration 400, including a climber component 402 attached to a harness 401, which may be non-limiting examples of climber component 108 and harness 115 of FIG. 1, respectively. In FIG. 4A, harness 401 is attached to an end of a webbing 432 of an auto-belay system (e.g., auto-belay system 104 of FIG. 1) via a locking carabiner 431 (e.g., an auto-belay carabiner). Locking carabiner 431 has a lock 433 that prevents locking carabiner 431 from being inadvertently or accidentally unclipped.

Climber component 402 includes a first portion 404, and a second portion 406. First portion 404 may be attached to harness 401 in various ways. For example, climber component 402 may be tied to harness 401 via a rope, sling, or similar material, or climber component 402 may be clipped to harness 401 via a mechanical device, such as a carabiner 410, as shown in the depicted embodiment. Second portion 406 may be semi-permanently connected to webbing 432 via a tether 408, for example, via a sewn loop at the end of webbing 432. In other examples, second portion 406 may be semi-permanently connected to locking carabiner 431 or attached to webbing 432 in a different way. In FIG. 4A, first portion 404 is attached to second portion 406. For example, first portion 404 may be magnetically attached to second portion 406, as described in greater detail below.

In the depicted embodiment, climber component 402 is attached to harness 401 via a harness loop 412 positioned on a right side of harness 401, such that a climber (e.g., climber 106) may easily access climber component 402 with a right hand of the climber. In other embodiments, climber component 402 may be attached to harness 401 via a harness loop on a left side of harness 401, such that the climber may easily access climber component 402 with a left hand of the climber. In still other embodiments, climber component 402 may be attached to harness 401 in a different manner. As the climber component 402 is attached to a harness, the size and weight of the climber component 402 is relatively small and light so as to not interfere with a climb. In some aspects, the climber component 402 is no more than 6 inches from the top of the first portion 404 to the bottom of the connected second portion 406. In some aspects, the climber component 402 may be 5 inches in length, 4 inches in length, 3 inches in length, two inches in length, 1 inch in length, or any fraction thereof. The width at the widest point of the first portion of the climber component 402 may be no more than four inches. For example, it may be 3 inches, 2.5 inches, 2 inches, 1 inch, or any fraction thereof. The weight of the first portion 404 may be no more than 60 grams, for example, 56 grams, 50 grams, 40 grams, 30 grams, 20 grams or any fraction thereof. A weight of the second portion 406 may be no more than 20 grams, for example, 15 grams, 10 grams, 5 grams, or any fraction thereof. Thus, the weight of the climber component 402 including the first portion and the second portion may be, for example, 66 grams.

FIG. 4B shows a second exemplary harness configuration 450, where second portion 406 is detached from first portion 404. Second portion 406 is shown dangling from the end of webbing 432 via tether 408. In FIG. 4B, carabiner 431 may be located at a starting point of a climbing route of a climbing wall (e.g., attached to an anchor point), and harness 401 may be worn by a climber while climbing on the route. Because carabiner 431 is not attached to harness 401, the climber may be climbing unprotected by the auto-belay system.

FIG. 5 shows a schematic diagram of a climbing notification system 500, which may be a non-limiting version of the climbing notification system 100 of FIG. 1. As described in reference to FIG. 1, climbing notification system 500 may be used in conjunction with an auto-belay system installed at a rock climbing wall, such as an artificial rock climbing wall of an indoor facility.

Climbing notification system 500 includes a climber component 501 and an antenna 550. Antenna 550 may comprise one or more antenna wires 552 installed at one or more predetermined heights of the rock climbing wall, as described above in reference to FIG. 1. Antenna 550 may transmit a wireless signal (e.g., an RF signal), which may be received by a sensor (sensor 508) within a threshold distance of the one or more antenna wires 552.

Antenna 550 may include an antenna box 554, which may include an adjustable range controller 556. Adjustable range controller 556 may include an amplifier 557 and a signal generator 559 and may use range adjustment control to increase or decrease a strength of a signal generated by signal generator 559 using amplifier 557. Adjustable range controller 556, amplifier 557, and signal generator 559 may be electronically coupled to a circuit board. Signal generator 559 may generate a signal receivable by climber component 501. In some embodiments, the signal may be a radiofrequency (RF) signal generated by an RF chip located in antenna box 554. In other embodiments, signal generator 559 may not rely on an RF chip. Adjustable range controller 556 may be used to adjust the strength of the signal to increase or decrease the threshold distance.

Antenna box 554 may also include a fan 558 that cools electrical components of antenna 550. In various embodiments, antenna box 554 includes an air filter 560, which may prevent an accumulation of chalk dust used by climbers on the electrical components. Additionally, antenna box 554 may include a power light 562, which may indicate whether antenna 550 is powered on, and a wire verification light 564, which may indicate whether a wire of the one or more antenna wires 552 is broken, to help quickly diagnose issues with antenna 550. Antenna box 554 may be powered by an external power supply. In some embodiments, antenna box 554 may include an amplifier.

Climber component 501 may be secured to a harness of (e.g., worn by) a climber climbing on the rock climbing wall, as described above in reference to FIGS. 4A and 4B. Climber component 501 includes a first portion 502 similar to first portion 404 and a second portion 520 similar to second portion 406. Second portion 520 may be a detachable portion, where in a first configuration, second portion 520 may be attached to first portion 502, or in a second configuration, second portion 520 may be detached from first portion 502. In various embodiments, second portion 520 includes a plurality of magnets exemplified by magnet 522, and second portion 520 is magnetically attached to first portion 502 via magnet 522. For example, second portion 520 may be magnetically attached to first portion 502 when a first surface (e.g., a bottom surface) of first portion 502 comes in contact with a second surface of second portion 520. In various embodiments, second portion 520 may be dangling from a rope or webbing (e.g., webbing 432) of the auto-belay system via a tether, and a climber wearing climber component 501 may manually grasp second portion 520 and place the second surface in contact with the first surface to magnetically attach second portion 520 to first portion 502. The magnetic attachment of the first portion 502 to the second surface of the second portion 520 may silence or prevent an alarm from sounding.

Climbing notification system 500 may include a processor 504 configured to execute machine-readable instructions stored in a non-transitory memory 506. Processor 504 may be any suitable processor, processing unit, or microprocessor, for example. Processor 504 may be a multi-processor system, and, thus, may include one or more additional processors that are identical or similar to each other and that are communicatively coupled via an interconnection bus. Processor 504 may be single core or multi-core, and the programs executed thereon may be configured for parallel or distributed processing. In some embodiments, processor 504 may optionally include individual components that are distributed throughout two or more devices, which may be remotely located and/or configured for coordinated processing.

Non-transitory memory 506 may include one or more data storage structures, such as optical memory devices, magnetic memory devices, or solid-state memory devices, for storing programs and routines executed by processor(s) 504 to carry out various functionalities disclosed herein. Non-transitory memory 506 may include any desired type of volatile and/or non-volatile memory such as, for example, static random access memory (SRAM), dynamic random access memory (DRAM), flash memory, read-only memory (ROM), etc.

In some embodiments, climbing notification system 500 may not include processor 504 and non-transitory memory 506, and a functioning of climber notification system 500 as described herein may be based on hard-wired connections on a circuit board. By eliminating processor 504, a probability of a defect in climbing notification system 500 due to a firmware bug may be reduced.

First portion 502 includes a battery 510, which may power processor 504 and/or other components of first portion 502. In various embodiments, battery 510 may be a rechargeable battery, such as a lithium-ion battery, that may be recharged via a USB port 516. By being able to recharge battery 510 via USB port 516, climber component 501 may not have to be disassembled for replacement of battery 510, which may result in a more positive user experience. In some aspects, it may allow the first portion 502 to be made of a housing formed of a single piece which may decrease the overall weight of the device. Additionally, the rechargeable battery may provide power for a longer period of time than a non-rechargeable battery, whereby the climber may have more confidence that climber component 501 will remain functional for extended periods of time than if the non-rechargeable battery were used. For example, battery 510 may be sized and/or configured to provide power for two weeks of use. While a USB port is shown, in some aspects charging may occur via other charging connectors including charging points such that when the device is placed in a charging station or base, the charging points connect with a power source and the device is recharged. In other aspects, a wireless charger such as a charging mat may be used.

First portion 502 may include one or more warning lights 514. A first warning light of the one or more warning lights 514 may be illuminated if an available power of battery 510 decreases below a threshold amount of power (e.g., a low-battery indicator). Additionally, in various embodiments, when the available power of battery 510 decreases below the threshold amount of power, a warning sound such as a chirp may be generated by first portion 502, to indicate to the climber that climber component 501 should be recharged. A second warning light of the one or more warning lights 514 may be used to alert the climber when the climber exceeds a predetermined height on the climbing wall, as described below. In some aspects, the warning lights may emit a steady light when activated. In other aspects, they display a blinking or patterned light emission. Such variations alone or in combination with audible alarms may convey different types of information. For example, the battery light may blink at a first charge level and be a steady light at a second charge level or vice versa.

First portion 502 may include a sensor 508 and an alarm 512. Sensor 508 may be configured to receive a signal transmitted by antenna 550 when sensor 508 enters a threshold proximity to antenna 550. For example, the threshold proximity may be 2-3 feet. Sensor 508 may enter the threshold proximity as a climber climbing the wall passes a location of antenna 550 on the rock-climbing wall (e.g., at the predetermined height). In various embodiments, antenna 550 may constantly and/or permanently transmit the signal.

When sensor 508 enters the threshold proximity of antenna 550, instructions stored in non-transitory memory 506 may be executed by processor 504 to determine whether second portion 520 is attached to first portion 502 (e.g., the first configuration) or whether second portion 520 is detached from first portion 502 (e.g., a second configuration). Specifically, first portion 502 includes a reed switch 518, which may be switched from a first position to a second position by one of the plurality of magnets represented by magnet 522 of second portion 520 and returned to the first position when the magnet 522 is removed. In other words, when second portion 520 is detached from first portion 502, reed switch 518 may be in the first position, where an electrical circuit of first portion 502 is unconnected. When second portion 520 is attached to first portion 502, reed switch 518 may be switched to the second position by a magnetic force emitted by magnet 522. In the second position, reed switch 518 may close electrical contacts of the electrical circuit, allowing electricity to pass through reed switch 518. Thus, a determination of whether second portion 520 is attached to first portion 502 may be made by determining whether a current passes through reed switch 518.

If second portion 520 is detached from first portion 502 when sensor 508 enters the threshold proximity to antenna 550, reed switch 518 is in the first position, and an electrical contact in circuitry of the first portion may be open, whereby the instructions stored in non-transitory memory 506 and executed by processor 504 may activate alarm 512. When alarm 512 is activated, an audio signal may be generated by first portion 502 that may warn the climber that the climber has reached the predetermined height and may not be connected to the auto-belay system, whereby the climber is at risk of injury in the event of a fall from the climbing wall. The alarm may be sufficiently loud to alert the climber. While varying decibel levels may be used, in one embodiment, a decibel level of the alarm is 95 db. The audio signal may be a beep, a tone, a chirp, or a different type of audio signal indicating a warning. Additionally, when alarm 512 is activated, a second warning light of the one or more warning lights 514 may be illuminated. The second warning light may provide an additional warning or notification to the climber that the climber has reached the predetermined height. For example, the climber may not hear alarm 512 due to a noise present at the climbing wall (e.g., a different alarm) at a time when alarm 512 is activated. However, the climber may see the second warning light, and realize that the climber is not connected to the auto-belay system. If the climber is not connected to the auto-belay system, the climber may descend the climbing wall to connect to the auto-belay system prior to climbing.

Alternatively, if second portion 520 is attached to first portion 502 when sensor 508 enters the threshold proximity to antenna 550, reed switch 518 is switched from the first position to the second position, and the electrical contact in the circuitry of the first portion may be closed, allowing a current to pass through reed switch 518 thereby disabling the alarm. The instructions stored in non-transitory memory 506 and executed by processor 504 may not activate alarm 512 and/or the second warning light. In some aspects, when the second portion 520 is attached to the first portion 502, the device may suspend or turn off, conserving the life of the battery.

It should be understood that climbing notification system 500 shown in FIG. 5 is for illustration, not for limitation. Another appropriate climbing notification system may include more, fewer, or different components.

FIG. 6A shows a front view of a climber component 600 of a climbing notification system, such as climbing notification system 100 of FIG. 1, climbing notification system 200 of FIG. 2, or climbing notification system 300 of FIG. 3. Climber component 600 may be a non-limiting example of climber component 108 of FIGS. 1-3 and/or climber component 402 of FIGS. 4A and 4B.

Climber component 600 has two portions: a first portion 602, and a second portion 604. First portion 602 has a first shape, and second portion 604 has a second shape. An outer perimeter of a bottom surface 614 of first portion 602 along an axial plane (e.g., formed by an X axis and a Z axis of reference axes 695) of climber component 600 mirrors an outer perimeter of a top surface of second portion 604 along the axial plane, such that the outer perimeter of top surface 616 may be brought into face sharing contact with the outer perimeter of bottom surface 614. In FIG. 6A, climber component 600 is shown in a first configuration, where second portion 604 is detached from first portion 602.

First portion 602 may include an aperture 606 at a first end 640 of first portion 602. Similarly, second portion 604 may include a second aperture 608, at a bottom end 642 of second portion 604. Aperture 606 may be used to attach first portion 602 to a harness of a climber using the climbing notification system, as described above in reference to FIGS. 4A and 4B. For example, aperture 606 may be sufficiently large to allow a climbing carabiner to clip first portion 602 to the harness, or to allow a sling, cord, or narrow rope to tie first portion 602 to the harness.

Second portion 604 may be connected to an end of a webbing 632 of an auto-belay system of a climbing wall (e.g., auto-belay system 104 of FIG. 1) via a tether 630. Second portion 604 may alternatively be attached to carabiner 631. Tether 630 may be secured to second portion 604 at a location 650 on an exterior surface of second portion 604. In various examples, tether 630 is tethered to second portion 604 via a handle 609 of second portion 604 created by aperture 608.

First portion 602 includes two warning lights (e.g., warning lights 514 of FIG. 5) positioned on the first exterior surface of first portion 602. A first warning light 610 may be a power indicator (e.g., a low battery indicator), which may indicate that an amount of power available at a power source (e.g., battery 510 of FIG. 5) has decreased below a threshold amount of power, whereby climber component 600 should be recharged. A second warning light 612 may be an alarm warning light, which may be activated when an alarm of climber component 600 is activated. The alarm may be activated when a climber wearing climber component 600 (e.g., with climber component 600 secured to a harness of the climber) reaches an antenna installed at a predetermined height of a climbing wall (e.g., antenna 120 of FIG. 1) when second portion 604 is detached from first portion 602. In various embodiments, first warning light 610 and/or second warning light 612 may be recessed to protect them from banging against components of the rock wall, which could cause damage. In one embodiment, first warning light 610 and/or second warning light 612 are LED lights mounted to a circuit board installed in first portion 602, where light from first warning light 610 and/or second warning light 612 is transported to a surface of a housing of first portion 602 via clear acrylic light pipes. In some aspects, the first portion 602 may include a speaker providing an audible alarm such as speaker 694. While speaker 694 is shown in a check shape, any regular or irregular shape may be used including for example circles, squares, rectangles, polygons, hexagons, and the like. In some aspects, the shape of the speaker may reflect a logo or other marketing aspect for the device.

In various embodiments, second portion 604 may be magnetically attached to first portion 602, via a magnet located within second portion 604. Specifically, second portion 604 may be magnetically attached to first portion 602 when second portion 604 is brought towards first portion 602 in a direction 692 and aligned with first portion 602 such that top surface 616 of second portion 604 comes in face sharing contact with bottom surface 614 of first portion 602. Second portion 604 may be magnetically detached from first portion 602 when second portion 604 is manually pulled away from first portion 602, in a direction 690, and bottom surface 614 is no longer in face sharing contact with top surface 616.

FIG. 6B shows a second configuration 660 of climber component 600, where in the second configuration, second portion 604 is attached to first portion 602, with bottom surface 614 of first portion 602 in face sharing contact with top surface 616 of second portion 604.

Figure 7:
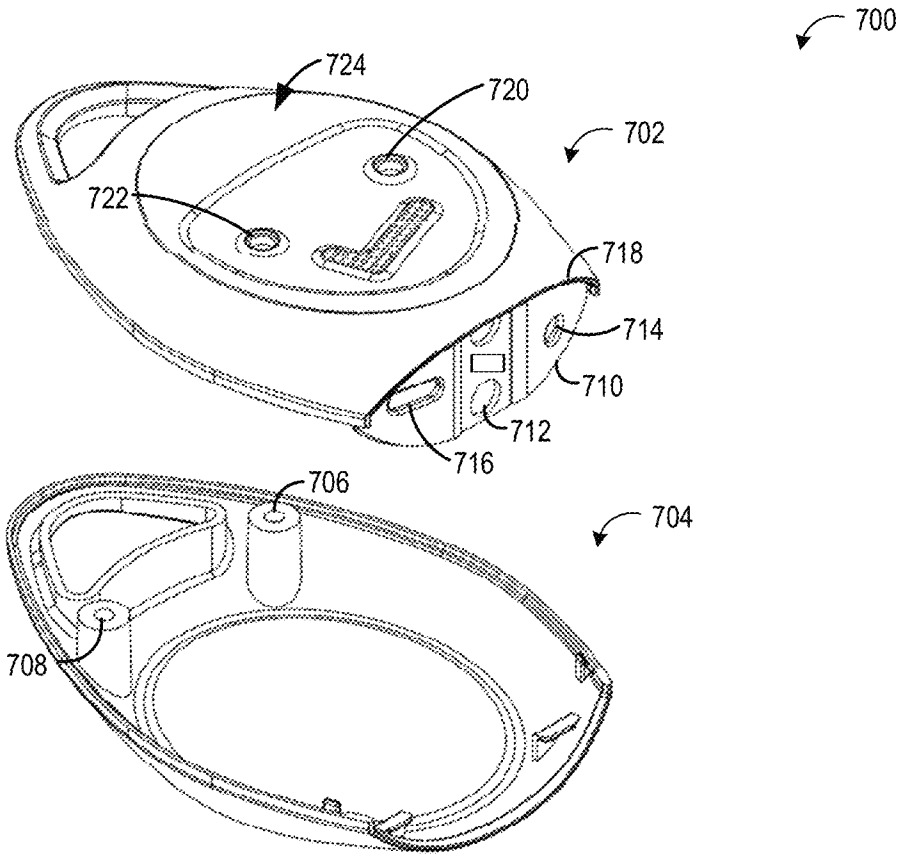
FIG. 7 shows a housing of the first portion of the climber component, in accordance with one or more embodiments of the present disclosure.
Figure 8:
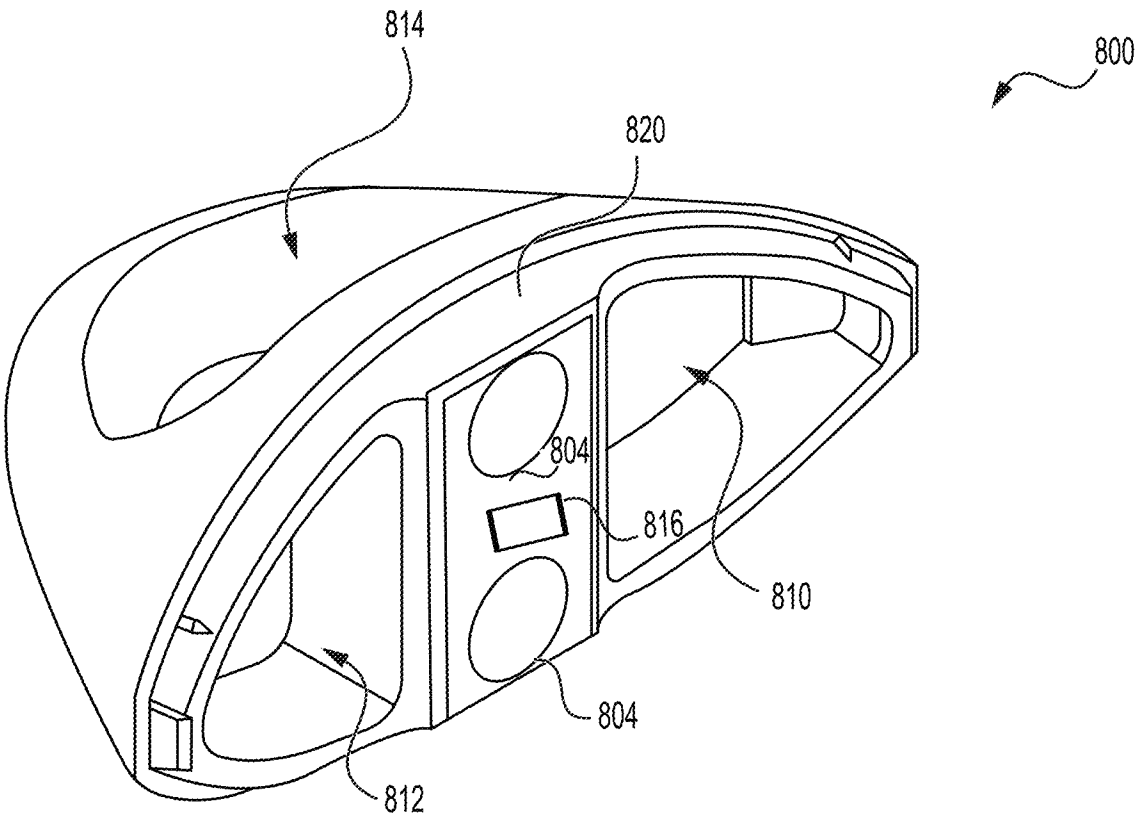
FIG. 8 shows a perspective view of the second, detachable portion of the climber component, in accordance with one or more embodiments of the present disclosure.

FIG. 7 shows a perspective view 700 of a housing of a first portion, (e.g., first portion 602 of FIGS. 6A and 6B) of a climber component, such as first portion 502 of climber component 501 of FIG. 5. Perspective view 700 includes a first, front housing 702 of the first portion, and a second, back housing 704 of the first portion. Front housing 702 may be coupled to back housing 704, for example, via screws inserted at a first location 706 and/or a second location 708. Front housing 702 and back housing 704 may be manufactured from a light and durable material, such as plastic. In some embodiments, front housing 702 and/or back housing 704 may be molded plastic. In some aspects, front housing 702 and back housing 704 may be formed together of a single piece of plastic.

Front housing 702 and back housing 704 may enclose various components of the climber component, such as, for example, a printed circuit board including a processor (e.g., processor 504 of FIG. 5), a non-transitory memory (e.g., non-transitory memory 506), a power source (e.g., battery 510), and an alarm (e.g., alarm 512). As described in greater detail above, instructions stored in the non-transitory memory may be executed to activate the alarm and/or illuminate a first warning light 720 arranged on a front surface 724 of front housing 702. The instructions stored in the non-transitory memory may be executed to illuminate second warning light 722 when an amount of available power at the power source decreases below a threshold power level.

Additionally, front housing 702 may include a bottom surface 710, which may include components that are hidden when a second portion of the climber component is attached to the first portion of the climber component depicted in FIG. 7. One or more terminals 712 made of iron, steel, or a different metal may be arranged on bottom surface 710, such that a magnet of the second portion may be brought into contact with the one or more terminals 712, thereby magnetically attaching the second portion to the first portion. A USB port 716 or other charging mechanism may be positioned on bottom surface 710, where a USB cable may be used to connect the first portion of the climber component to an external power source. Additionally, in some embodiments, the USB cable may be connected to a computing device such as a smart phone, tablet, or PC, where a user interface of the climber component may be displayed that may allow a user of the climber component to adjust one or more settings of the climber component, diagnose a defect in the climber component, perform a test on the climber component, etc. For example, in some embodiments, the user may customize a type or a volume of an alarm of the climber component to a particular climber.

In some embodiments, a test button 714 may be included on bottom surface 710. An operator of the climber component may press test button 714, for example, to test the alarm, alarm warning light, and/or a different component of the climber component. Test button 714 and/or USB port 716 may be recessed into bottom surface 710, such that test button 714 and/or USB port 716 are hidden from view and do not come in contact with a surface of the second portion of the climber component when the second portion is magnetically attached to the first portion. Additionally, front exterior housing 702 may include a lip 718, which may protect the components arranged on bottom surface 710.

FIG. 8 shows a perspective view of a second portion 800 of a climber component, such as second portion 406 of climber component 402 of FIGS. 4A and 4B and second portion 604 of climber component 600 of FIGS. 6A and 6B. Second portion 800 may be manufactured of a same or similar light durable material as the exterior surfaces of a first portion of the climber component, described above in reference to FIG. 7. Second portion 800 may include one or more hollow areas, such as an aperture 814 (e.g., aperture 608 of FIGS. 6A and 6B), a first hollow portion 810, and a second hollow portion 812. Including first hollow portion 810 and second hollow portion 812 may reduce a weight of second portion 800 and the climber component overall, which may be more desirable to a climber using the climber component. For example, in some aspects, the second portion may weigh about 1 g to 20 grams, 15 grams, 10 grams, 5 grams, or any fraction thereof.

Second portion 800 may additionally include one or more magnets 804, which may be arranged on a surface 820 (e.g., top surface 616) of second portion 800. As described above in reference to FIGS. 6A and 6B, second portion 800 may be magnetically attached to the first portion of the climber component by bringing surface 820 into face sharing contact with a corresponding surface (e.g., bottom surface 614) of the first portion. Specifically, the one or more magnets 804 may be brought into face sharing contact with one or more steel or metal plates are components of the first portion, such as the terminals 712 described above in relation to FIG. 7.

In some aspects, the second portion 800 may additionally include a third magnet 816. Magnet 816 may be positioned such that when the second portion is brought into face sharing contact with the first portion, magnet 816 moves the reed switch in the first portion from a first position into a second position, deactivating the alarm.

FIG. 9 shows a method 900 for activating an alarm of a climber component of a climbing notification system, such as climber component 501 of climbing notification system 500 of FIG. 5 and described in reference to FIGS. 1-4, and 6-8. The alarm may be activated when a climber wearing the climber component exceeds a threshold height on a climbing wall protected by the climbing notification system, without being connected to an auto-belay system installed at the climbing wall. The auto-belay system may protect the climber from an injury in the event of a fall. Method 900 may be executed by processor of the climber component, such as processor 504, based on instructions stored in a memory of the climber component, such as non-transitory memory 506.

Note that while method 900 is described below as a sequence of steps performed by the processor, in some embodiments, the climber component may not include a processor. In such embodiments, the functions described below may be performed based on hard-wired connections and may be executed in parallel. For example, the alarm may be independent of a battery warning light, whereby the alarm may remain fully functional until a battery of the climber component is exhausted.

Method 900 begins at 902, where method 900 includes determining whether an amount of power available at a battery of the climber component is below a threshold amount of power. If the amount of power available at the battery is below the threshold amount of power, it may be inferred that the battery is low and should be recharged. If at 902 it is determined that the available power at the battery is below the threshold amount of power, method 900 proceeds to 904. At 904, method 900 includes illuminating a low-battery warning light on a surface of the climber component, such as first warning light 610 of FIGS. 6A and 6B. In response to the low-battery warning light being illuminated, the climber may recharge the battery. For example, the climber may recharge the battery by plugging a USB cable into a USB port of the climber component (e.g., USB port 716 of FIG. 7) and connecting the climber component to an external power source.

Alternatively, if at 902 it is determined that the amount of the power available at the battery is greater than the threshold amount of power, method 900 proceeds to 906. At 906, method 900 includes determining whether an antenna of the climbing notification system (e.g., antenna 120 of FIG. 1 and/or antenna 550 of FIG. 5) is within a threshold distance of the climber component. In various embodiments, the antenna is permanently connected and permanently on, such that the antenna is constantly broadcasting a wireless signal. In some aspects, the signal sent by the antenna may be omnidirectional. In other aspects, the signal may be a directional antenna. Further, the radius of the signal may be adjusted depending on the placement of the antenna and the distance to a climber.

For example, the wireless signal may be an RF signal generated by an RF chip of the antenna. Determining whether the antenna of the climbing notification system is within the threshold distance of the climber component may include determining whether the wireless signal is received at a sensor of the climber component (e.g., sensor 508).

If the wireless signal of the antenna is not received at the sensor, it may be inferred that the antenna is not within the threshold distance of the climber component, whereby method 900 proceeds to 908. At 908, method 900 includes delaying until the climber component is within the threshold distance of the antenna, and method 900 proceeds back to 906.

Alternatively, if the wireless signal of the antenna is received at the sensor, it may be inferred that the antenna is within the threshold distance of the climber component, and method 900 proceeds to 910.

At 910, method 900 includes determining whether a second, detachable portion of the climber component (e.g., the second, detachable portion 406 of FIG. 4B and 604 of FIGS. 6A and 6B) is magnetically coupled to a first portion of the climber component (e.g., first portion 404 or first portion 602). The climber may be expected and/or encouraged to attach the second, detachable portion to the first portion at a time of attaching an end of a rope of the auto-belay system to a harness of the climber. As a result, if it is determined that the second, detachable portion of the climber component is magnetically coupled to the first portion of the climber component, it may be inferred that the climber has attached the end of a rope of an auto-belay system installed at the climbing wall to a harness of the climber, whereby the climber may be protected by the auto-belay system. As a result of the climber being protected by the auto-belay system, method 900 proceeds to 912. At 912, method 900 includes maintaining a state of the device, and method 900 ends.

Alternatively, if it is determined at 910 that the second, detachable portion of the climber component is not attached to the first portion of the climber component, it may be inferred that the climber may not have attached the auto-belay carabiner (e.g., locking carabiner 431 of FIGS. 4A and 4B) to the harness of the climber. As a result of determining that the second, detachable portion of the climber component is not attached to the first portion, method 900 proceeds to 914. At 914, method 900 includes activating an alarm of the climber component. Method 900 may also include illuminating an alarm warning light on a surface of the climber component, such as second warning light 612 of FIGS. 6A and 6B. Further, in some embodiments, other types of notification may be provided to the climber. For example, a vibration of the climber component may be activated.

Referring now to FIG. 10, a timing diagram 1000 is shown that illustrates a first sequence of events that occur as a climber performs a climb on a climbing wall (e.g., climbing wall 102) while using an auto-belay system in conjunction with a climbing notification system, such as the climbing notification system of FIG. 1. The horizontal (x-axis) denotes time and the vertical lines t1-t5 identify significant times in the sequence of events.

Timing diagram 1000 includes seven plots. A first plot, line 1002, shows a status of an antenna (e.g., antenna 120) of the climbing notification system, where the antenna is installed at a predetermined height at the climbing wall. For example, the antenna may be installed behind a back surface of the climbing wall, or a second wall behind the climbing wall, such that the antenna is not visible by the climber. The status of the antenna may be ON, meaning that the antenna is broadcasting a signal (e.g., an RF signal) that is detectable by a climber component of the climbing notification system, or OFF, meaning that the antenna is not broadcasting the signal detectable by the climber component. The climber component may be a device secured to a harness or other safety equipment of the climber, as described above in reference to FIGS. 4A and 4B. The second plot, line 1004, shows a status of the auto-belay system used to protect the climber from a fall-related injury while climbing on the climbing wall. The climber may be CONNECTED to the auto-belay system, or the climber may be UNCONNECTED to the auto-belay system. The third plot, line 1006, indicates whether the climber is climbing on the climbing wall or not climbing on the climbing wall. For the purposes of FIG. 10, climbing includes descending a climb. The fourth plot, line 1008, shows a configuration of the climber component, where a second, detachable portion of the climber component (e.g., detachable portion 604 of FIGS. 6A and 6B) is ATTACHED to a first portion of the climber component (e.g., first portion 602), or DETACHED from the first portion. As described above in reference to FIGS. 6A and 6B, the second, detachable portion may be magnetically attached to the first portion by bringing a top surface (e.g., top surface 616) of the second, detachable portion in contact with a bottom surface (e.g., bottom surface 614) of the first portion. The fifth plot, line 1010, indicates a status of an alarm (e.g., alarm 512 of FIG. 5) generated at the first portion of the climber component, where the alarm may be ON or the alarm may be OFF. The sixth plot, line 1012, indicates a status of an alarm warning light (e.g., second warning light 612) of the climber component, where the alarm warning light may be ON or the alarm warning light may be OFF. The seventh plot, line 1014, indicates a height of the climber on the climbing wall, between a BOTTOM of the climb and a TOP of the climb. A dashed line 1016 indicates a predetermined height (e.g., predetermined height 130 of FIG. 1) at which the antenna is arranged at the climbing wall.

At time t0, the antenna is ON. The climber has not yet begun to climb, as shown by line 1006, and the climber is not connected to the auto-belay system (e.g., by clipping in to the auto-belay system). The second, detachable portion of the climber component is DETACHED from the first portion of the climber component. For example, the second, detachable portion may be dangling from an end of a rope or webbing of the auto-belay system, or an auto-belay carabiner attached to the end of the webbing, by a tether. The length of the tether may be selected such that the climber may reach the dangling second portion with their hand. The alarm and warning light are OFF.

At time t1, the climber is preparing to climb. In accordance with rules for the climbing wall and/or best practices, the climber is encouraged to connect to the auto-belay system, as indicated by dashed line 1005. Additionally, when connecting to the auto-belay system, the climber should attach the second, detachable portion of the climber component to the first portion of the climber component, as shown by dashed line 1007, to deactivate the alarm. However, the climber forgets to connect to the auto-belay system, where the auto-belay system remains UNCONNECTED, as indicated by line 1004. The climber also forgets to attach the second, detachable component to the first portion of the climber component, as indicated by line 1008.

At time t2, the climber begins to climb up the climbing wall, as indicated by line 1006. As a result of forgetting to connect to the auto-belay system, the climber is climbing unprotected by the webbing of the auto-belay system, whereby the climber is susceptible to a fall-related injury in the event of a fall from the climbing wall. Between time t2 and t3, the climber climbs up a climbing route of the climbing wall, as indicated by line 1014.

At time t3, the climber reaches the predetermined height of the antenna, indicated by dashed line 1016. When the climber reaches the predetermined height, the climber component secured to the harness of the climber enters within a threshold proximity of the antenna, whereby a sensor (e.g., sensor 508) of the climber component detects the signal broadcasted by the antenna. When the signal is detected by the sensor, a processor of the climber component (e.g., processor 504) determines whether the second, detachable portion is attached to the first portion of the climber component. As the second, detachable portion is DETACHED, as shown by line 1008, the alarm is activated, as shown by line 1010. Concurrently, the alarm warning light is activated, as indicated by line 1012. When the climber hears the alarm, and sees the alarm warning light, both of which indicate that the second, detachable portion of the climber component is not attached to the first portion of the climber component. As a result of the second, detachable portion not being attached to the first portion, the climber realizes that he has forgotten to connect to the auto-belay system, and that the second, detachable portion is connected to the webbing of the auto-belay system at the bottom of the climb. The climber begins to descend the climbing wall to deactivate the alarm and warning light.

At time t4, the climber descends below the predetermined height, and outside the threshold proximity of the antenna, whereby the alarm and alarm warning light are deactivated. Between time t4 and t5, the climber descends the climbing wall, having realized that the auto-belay has not been connected to the harness.

At time t5, the climber reaches the bottom of the climbing wall. As a result of hearing the alarm and seeing the alarm warning light, the climber does not exceed the predetermined height of the antenna, a height at which the climber could experience a higher risk of serious injury from a fall. Thus, the climber is protected from climbing too high without protection by the climbing notification system.

In contrast, FIG. 11 shows a second timing diagram 1100 that illustrates a second sequence of events that occur as the climber performs a climb while using an auto-belay system in conjunction with the climbing notification system, where the alarm of the climbing notification system is not triggered. As in timing diagram 1000, the horizontal (x-axis) denotes time and the vertical lines t1-t5 identify significant times in the sequence of events.

Timing diagram 1100 includes seven plots. A first plot, line 1102, shows a status of an antenna of the climbing notification system, where the antenna is installed at a predetermined height at the climbing wall. The status of the antenna may be ON, meaning that the antenna is broadcasting a signal (e.g., an RF signal) that is detectable by a climber component of the climbing notification system, or OFF, meaning that the antenna is not broadcasting the signal detectable by the climber component. The second plot, line 1104, shows a status of the auto-belay system used to protect the climber from a fall-related injury while climbing on the climbing wall, where the climber may be CONNECTED to the auto-belay system, or the climber may be UNCONNECTED to the auto-belay system. The third plot, line 1106, indicates whether the climber is climbing on the climbing wall or not climbing on the climbing wall. The fourth plot, line 1108, shows a configuration of the climber component, where a second, detachable portion of the climber component is ATTACHED to a first portion of the climber component, or DETACHED from the first portion. The fifth plot, line 1110, indicates a status of an alarm generated at the first portion of the climber component, where the alarm may be ON or the alarm may be OFF. The sixth plot, line 1112, indicates a status of an alarm warning light of the climber component, where the alarm warning light may be ON or the alarm warning light may be OFF. The seventh plot, line 1114, indicates a height of the climber on the climbing wall, between a BOTTOM of the climb and a TOP of the climb. A dashed line 1116 indicates a predetermined height at which the antenna is arranged at the climbing wall.

In timing diagram 1100, at time t0, the antenna is ON. The climber has not yet begun to climb, and the climber is not connected to the auto-belay system. The second, detachable portion of the climber component is DETACHED from the first portion of the climber component.

At time t1, the climber is preparing to climb. In accordance with rules for the climbing wall and/or best practices, the climber connects to the auto-belay system, as indicated by line 1104. The climber also attaches the second, detachable portion of the climber component to the first portion of the climber component, as shown by line 1108, to deactivate the alarm.

At time t2, the climber begins to climb up the climbing wall, as indicated by line 1106. Between time t2 and t3, the climber climbs up a climbing route of the climbing wall, as indicated by line 1114.

At time t3, the climber reaches the predetermined height of the antenna, indicated by dashed line 1116. When the climber reaches the predetermined height, the climber component secured to the harness of the climber enters within the threshold proximity of the antenna, whereby the sensor of the climber component detects the signal broadcasted by the antenna. When the signal is detected by the sensor, the processor of the climber component determines whether the second, detachable portion is attached to the first portion of the climber component. As the second, detachable portion is ATTACHED, as shown by line 1108, the alarm and the alarm warning light are disabled (e.g., not activated), as indicated by lines 1110 and 1112. The alarm is consequently not generated.

Between time t4 and t5, the climber continues climbing up the climbing wall, passing the predetermined height of the antenna, with the protection of the auto-belay system. At time t5, the climber reaches the top of the climbing wall.

Thus, a climbing notification system is described herein that may aid a climber climbing a climbing wall in remembering to connect to an auto-belay system installed on the climbing wall, in order to protect the climber from being injured as a result of a fall. If the climber connects to the auto-belay system by clipping a rope or webbing into the climber's harness, a braking mechanism of the auto-belay system may arrest a potential fall of the climber. If the climber fails to connect to the auto-belay system, the climber may fall to the ground, and potentially suffer an injury. To help the climber remember to connect to the auto-belay system, the climbing notification system may be installed at the climbing wall, including a climber component attached to a harness of the climber, and an antenna attached at a predetermined height of the climbing wall. When the climber prepares to begin climbing, at a time of attaching the auto-belay carabiner to the harness, the climber magnetically attaches a first portion of the climber component to a second portion of the climber component, thereby completing a circuit and disabling an alarm of the climber component. As a result of attaching the first portion to the second portion, the climber may climb past the antenna installed at the predetermined height without the alarm being generated.

Thus, a first action of attaching the auto-belay carabiner to the harness and a second action of attaching the first portion to the second portion are performed in a sequence at a same time. If the climber forgets to attach the auto-belay carabiner to the harness, the climber may also forget to attach the first portion to the second portion, as both actions are typically performed in the sequence at the same time. As a result, when the climber reaches the predetermined height with the climber component in a detached configuration (e.g., where the first portion is not attached to the second portion) the alarm will be generated at the climber component, indicating to the climber that the climber may not be connected to the auto-belay system. When the climber hears the alarm and/or sees a warning light on the climber component associated with the alarm, the climber may verify whether the auto-belay carabiner is attached to the harness of the climber. If the auto-belay carabiner is attached to the harness, the climber may attach the second portion to the first portion, thereby disabling the alarm and warning light, and continue to climb to the top of the climbing wall. If the auto-belay carabiner is not attached to the harness, the climber may descend the climbing wall from the predetermined height to the ground, clip into the auto-belay system, and attach the second portion to the first portion prior to continuing to climb. In this way, the climbing notification system ensures that the climber does not exceed the predetermined height, at which point the climber may suffer an injury in the event of a fall.

The first portion and second portion may be connected via a tether, such that the second portion may easily be reached by the climber with one hand and connected to the first portion, to disable the alarm in an efficient and timely manner. The volume of the alarm may be adjusted to minimize a distraction to other nearby climbers and may be customized to a climber to avoid confusion regarding which climber is unprotected. In this way, by providing individual, customized alarms at a lower volume than other sensing systems, and by enabling the climber to quickly disable the alarm, an annoyance and/or distraction created by the climbing notification system may be lower than other alternative climbing notification systems, resulting in a more pleasurable climbing experience and an increased climbing performance. Additionally, since the processing of the signal received by a sensor and the generation of the alarm occurs at the climber component, rather than a separate component of the climbing notification system, a complexity and number of components of the climbing notification system that might fail may be reduced, increasing safety and decreasing a cost of the climbing notification system with respect to other alternative climbing notification systems. Further, because the processing relies on a single sensor and a circuit interrupted by a reed switch, a power consumption of each individual climber component may be less than a power consumption of an alternative climbing notification system, resulting in more reliable and long-lasting protection than offered by the alternative fall protection navigation systems.

The technical effect of generating an alarm at a device worn by a climber while climbing on a climbing wall in response to the climber exceeding a threshold height with a first portion of the device detached from a second portion, and not generating the alarm in response to the first portion being attached to the second portion, is that the climber may not continue climbing above the threshold height, thereby reducing the possibility of a fall-related injury.

The disclosure also provides support for a climbing notification system, comprising a climber component coupled to a harness, the climber component comprising: a first portion including a processor, a single sensor and an alarm, a second, detachable portion semi-permanently attached to a first, bottom surface of the first portion, the second, detachable portion magnetically couplable to the first portion, and a power source, wherein: in a first condition, where the second, detachable portion is magnetically coupled to first portion, the alarm is disabled, and in a second condition, where the second, detachable portion is detached from the first portion, the alarm is generated in response to the single sensor detecting a threshold proximity to an antenna positioned at a predetermined height. In a first example of the system, the first portion includes at least two warning lights. In a second example of the system, optionally including the first example, a first warning light of the at least two warning lights indicates a low battery and a second warning light of the at least two warning lights indicates alarm activation. In a third example of the system, optionally including one or both of the first and second examples, at least two warning lights are recessed. In a fourth example of the system, optionally including one or more or each of the first through third examples, the power source lasts for two weeks. In a fifth example of the system, optionally including one or more or each of the first through fourth examples, the first portion has a first shape and the second, detachable portion has a second shape, and wherein an outer perimeter of a bottom surface of the first portion along an axial plane mirrors an outer perimeter of a top surface of the second, detachable portion along an axial plane and the outer perimeter of the bottom surface of the first portion is in-face sharing contact with the outer perimeter of the top surface of the second, detachable portion. In a sixth example of the system, optionally including one or more or each of the first through fifth examples, the bottom surface of the first portion comprises a recessed USB port or other charging connecter. In some aspects, the charging connector may be charging points such that when the device is placed in a charging station or base, the charging points connect with a power source and the device is recharged. In other aspects, the charger may be a charging mat. In a seventh example of the system, optionally including one or more or each of the first through sixth examples, the bottom surface of the first portion comprises a recessed test button. In an eighth example of the system, optionally including one or more or each of the first through seventh examples, when the bottom surface of the first portion and the top surface of the second, detachable portion are attached, the recessed USB port is hidden. In a ninth example of the system, optionally including one or more or each of the first through eighth examples, the second, detachable portion comprises a plurality of magnets. In a tenth example of the system, optionally including one or more or each of the first through ninth examples, the first portion comprises a reed switch. In a eleventh example of the system, optionally including one or more or each of the first through tenth examples, when the first portion and the second, detachable portion are connected, magnet of the plurality of magnets moves the reed switch into a position that closes an electrical contact. In a twelfth example of the system, optionally including one or more or each of the first through eleventh examples, the alarm has a decibel level of 95 db. In a thirteenth example of the system, optionally including one or more or each of the first through twelfth examples, the system further comprises: an adjustable range controller including a signal generator and an amplifier. In a fourteenth example of the system, optionally including one or more or each of the first through thirteenth examples, the adjustable range controller emits continuously. In a fifteenth example of the system, optionally including one or more or each of the first through fourteenth examples, the adjustable range controller comprises a first antenna box inside a second antenna box, wherein the first antenna box and the second antenna box comprises a fan and a filter.

The disclosure also provides support for a method for a climbing notification system, the method comprising: detecting a proximity of a wireless alarm unit to an antenna of the climbing notification system, and determining whether a detachable magnetic component of a wireless alarm unit of the climbing notification system is coupled to the wireless alarm unit, in a first condition, where the detachable magnetic component is coupled to the wireless alarm unit, disabling the wireless alarm unit, and in a second condition, where the detachable magnetic component is not coupled to the wireless alarm unit activating an alarm in the wireless alarm unit, wherein the wireless alarm unit comprises a first portion including a single sensor and the wireless alarm, the detachable magnetic component, the magnetic component couplable to the first portion. In a first example of the method, in the first condition, the detachable magnetic component closes contacts in a reed switch in the first portion. In a second example of the method, optionally including the first example, in the second condition, the contacts of the reed switch are open.

When introducing elements of various embodiments of the present disclosure, the articles "a," "an," and "the" are intended to mean that there are one or more of the elements. The terms "first," "second," and the like, do not denote any order, quantity, or importance, but rather are used to distinguish one element from another. The terms "comprising," "including," and "having" are intended to be inclusive and mean that there may be additional elements other than the listed elements. As the terms "connected to," "coupled to," etc. are used herein, one object (e.g., a material, element, structure, member, etc.) can be connected to or coupled to another object regardless of whether the one object is directly connected or coupled to the other object or whether there are one or more intervening objects between the one object and the other object. In addition, it should be understood that references to "one embodiment" or "an embodiment" of the present disclosure are not intended to be interpreted as excluding the existence of additional embodiments that also incorporate the recited features.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, the examples and embodiments, in all respects, are meant to be illustrative only and should not be construed to be limiting in any manner.

The invention claimed is:

1. A climbing notification system, comprising:

a climber component coupled to a harness, the climber component comprising:

a first portion including a processor, a single sensor, and an alarm;

a second, detachable portion semi-permanently attached to a first, bottom surface of the first portion, the second, detachable portion magnetically couplable to the first portion; and a power source;

wherein:

in a first condition, where the second, detachable portion is magnetically coupled to first portion, the alarm is disabled; and in a second condition, where the second, detachable portion is detached from the first portion, the alarm is generated in response to the single sensor detecting a threshold proximity to an antenna positioned at a predetermined height.

2. The climbing notification system of claim 1, wherein the first portion includes at least two warning lights.

3. The climbing notification system of claim 2, wherein a first warning light of the at least two warning lights indicates a low battery and a second warning light of the at least two warning lights indicates alarm activation.

4. The climbing notification system of claim 2, wherein the at least two warning lights are recessed.

5. The climbing notification system of claim 1, wherein the power source lasts for two weeks.

6. The climbing notification system of claim 1, wherein the first portion has a first shape and the second, detachable portion has a second shape, and wherein an outer perimeter of a bottom surface of the first portion along an axial plane mirrors an outer perimeter of a top surface of the second, detachable portion along an axial plane and the outer perimeter of the bottom surface of the first portion is in face sharing contact with the outer perimeter of the top surface of the second, detachable portion.

7. The climbing notification system of claim 6, wherein the bottom surface of the first portion comprises a charging connector.

8. The climbing notification system of claim 7, wherein the bottom surface of the first portion comprises a recessed test button.

9. The climbing notification system of claim 8, wherein when the bottom surface of the first portion and the top surface of the second, detachable portion are attached, the charging connector is hidden.

10. The climbing notification system of claim 1, wherein the second, detachable portion comprises a plurality of magnets.

11. The climbing notification system of claim 10, wherein the first portion comprises a reed switch.

12. The climbing notification system of claim 11, wherein when the first portion and the second, detachable portion are connected, a magnet of the plurality of magnets moves the reed switch into a position that closes an electrical contact.

13. The climbing notification system of claim 1, wherein the alarm has a decibel level of 95 db.

14. The climbing notification system of claim 1 further comprising an adjustable range controller including a signal generator and an amplifier, wherein the adjustable range controller controls a strength of a signal generated by the signal generator using the amplifier.

15. The climbing notification system of claim 14, wherein the adjustable range controller emits continuously.

16. The climbing notification system of claim 14, wherein the adjustable range controller comprises a first antenna box inside a second antenna box, wherein the first antenna box comprises a filter and the second antenna box comprises a fan and a filter.

17. A method for a climbing notification system, the method comprising:

detecting a proximity of a wireless alarm unit to an antenna of the climbing notification system, wherein the wireless alarm unit comprises a first portion including a single sensor and a wireless alarm and a second portion comprising a detachable magnetic component; and when the wireless alarm unit is within a threshold proximity of the antenna, determining whether the detachable magnetic component of the wireless alarm unit of the climbing notification system is coupled to the first portion of the wireless alarm unit; and in a first condition, where the detachable magnetic component is coupled to the wireless alarm unit, disabling the wireless alarm unit; and in a second condition, where the detachable magnetic component is not coupled to the wireless alarm unit activating an alarm in the wireless alarm unit.

18. The method of claim 17, wherein in the first condition, the detachable magnetic component closes contacts in a reed switch in the first portion.

19. The method of claim 18, wherein in the second condition, the contacts of the reed switch are open.

* * * * *